US006477114B1

(12) United States Patent
Mutoh et al.

(10) Patent No.: US 6,477,114 B1
(45) Date of Patent: Nov. 5, 2002

(54) ELECTRONIC TIMEPIECE WITH CALENDAR DEVICE

(75) Inventors: Takeo Mutoh, Tokyo (JP); Yasuo Kitajima, Sayama (JP); Haruhiko Higuchi, Tokorozawa (JP); Hiroyuki Koike, Tokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/380,155

(22) PCT Filed: Dec. 25, 1998

(86) PCT No.: PCT/JP98/05900

§ 371 (c)(1),
(2), (4) Date: Aug. 26, 1999

(87) PCT Pub. No.: WO99/34263

PCT Pub. Date: Jul. 8, 1999

(30) Foreign Application Priority Data

Dec. 26, 1997 (JP) ..... 9-359759
Jan. 9, 1998 (JP) ..... 10-2821

(51) Int. Cl.[7] ..... G04B 19/24
(52) U.S. Cl. ..... 368/28; 368/35
(58) Field of Search ..... 368/21–33

(56) References Cited

U.S. PATENT DOCUMENTS 4,695,168 A * 9/1987 Meister et al. ..... 368/31
4,733,384 A * 3/1988 Meister et al. ..... 368/28
5,187,693 A * 2/1993 Besson ..... 368/35
5,305,289 A * 4/1994 Besson et al. ..... 368/28
5,327,401 A * 7/1994 Besson et al. ..... 368/28
6,046,964 A * 4/2000 Higuchi et al. ..... 368/28
6,088,300 A * 7/2000 Nakajima et al. ..... 368/28
6,088,302 A * 7/2000 Nakjima et al. ..... 368/35
6,097,627 A * 8/2000 Kitahara et al. ..... 368/35
6,185,158 B1 * 2/2001 Ito et al. ..... 368/28
6,278,661 B1 * 8/2001 Higuchi et al. ..... 368/28
6,385,136 B2 * 5/2002 Higuchi et al. ..... 368/28

FOREIGN PATENT DOCUMENTS

| | | |
|---|---|---|
| JP | 51-52867 | 5/1976 |
| JP | 62-75373 | 4/1987 |
| JP | 3-90888 | 4/1991 |
| JP | 4-62496 | 2/1992 |
| JP | 5-66279 | 3/1993 |
| JP | 9-218275 | 8/1997 |

* cited by examiner

*Primary Examiner*—David Martin
*Assistant Examiner*—Jeanne-Marguerite Goodwin
(74) *Attorney, Agent, or Firm*—Dickstein Shapiro Morin & Oshinsky LLP

(57) ABSTRACT

An electronic timepiece has a calendar advancement device resistant to external shock and capable of achieving date correction in a short time. A date dial advancement transducer (51) is activated in response to a date dial drive signal generated by a 24-hour switch. A date advancement mechanism (a date gear train) (52) employs a Geneva wheel for stabilizing the date dial (70). A bounding restraint lever is regulated using an eccentric cam or the like provided coaxially with the Geneva wheel.

20 Claims, 16 Drawing Sheets

ELECTRONIC TIMEPIECE WITH CALENDAR DEVICE

BACKGROUND OF THE INVENTION

1. Field of the Invention

The present invention relates to an electronic timepiece having a calendar device which uses a rotating date indication panel or a date dial.

2. Description of the Related Art

In common calendar systems for a conventional wrist watch with a calendar, a date dial is driven by a date dial driving wheel which makes one complete rotation every twenty-four hours, and which constitutes a known date drive gear train interlocked with a time indication gear train. Therefore, changing date indication may require about two hours of advancement time.

It has also conventionally been proposed that an analog indication watch employs a Geneva mechanism for advancement and stabilization of a date dial. In one technique proposed, for example, in Japanese Patent Publication No. Hei 6-27880, a Geneva wheel is provided, which is continuously driven by a continuously driven hand gear train, so as to intermittently rotate a date dial driving wheel for advancing a date dial.

According to this proposal, however, the Geneva wheel, the rotation of which is based on the rotation velocity of the hand gear train, rotates only at a slow speed. Therefore, as much as ten to twenty minutes are required to fully advance the date dial. As a result, rotation restraint applied to the date dial driving wheel by the flange of the Geneva wheel may fail, causing improper movement of the date dial when external shock is applied to the timepiece during such a large amount of time for advancement, during which the date dial driving wheel is driven by the feed tooth of the Geneva wheel.

Meanwhile, positioning for conventional rotation restraint imposed on the date dial has been achieved using a bounding restraint lever. The date dial is pressed with a larger force as it is driven for date change until the force peaks when a tooth of the gear of the date dial passes over the apex of a convex of the bounding restraint lever.

In a method for driving a date dial by using a date dial driving wheel, which is rotated by a date drive gear train, date change can be successfully achieved irrespective of variation of the pressing force onto the date dial by the bounding restraint lever because the rotation torque of the date dial driving wheel is sufficiently large.

In either case, however, too much time is required to change dates and the period of no-date indication between adjacent date indications, during which the present date indication cannot be easily read, remains too long.

In order to solve the above problems, various proposals have been made to reduce a date dial advancement time to facilitate date indication reading. One proposal is such that a date advancement nail, which constitutes a date dial driving wheel making one complete rotation for twenty-four hours, is instantly activated so that the date dial is advanced instantly. Such a date dial driving wheel, however, has problems including complicated structure, increased cost, and thick movements resulting from a required large cross sectional arrangement size for a date dial driving wheel, a date dial, and associated members.

Another proposal is such that, in a conventional calendar mechanism having a date dial driving wheel, which makes one complete rotation for twenty-hour hours, an indication wheel (a date dial) is driven using a date advancement transducer (a date step motor) dedicated to drive the date dial (an indication wheel), an electronic circuit for drive-controlling the date step motor, a gear train, and a drive wheel.

Specifically, in a preferred embodiment disclosed in Japanese Utility Laid-open No. Hei 4-124494, a step motor is driven in response to a drive pulse from an electronic circuit to transmit rotation via a gear train to a drive wheel to drive an indication wheel. Also, under control by the electronic circuit, a pulse in an opposite direction from that of the drive pulse is output when completing the drive so that right and left backlash of the drive and indication wheels is equalized. With this arrangement, date dial advancement time is reduced and the date indication can be read more easily.

However, a calendar mechanism in which respective members of a date step motor, in particular, a series of components from a rotor to a date dial, constitute a slowdown gear train, has the following problems.

That is, since the date dial is kept positioned utilizing magnetic retention of a rotor which constitutes a date step motor, the date dial may be displaced from its stationary stabilized position when it receives external disturbance (including shock due to a swinging arm) and thereby generates inertial force resulting in rotating the rotor via the interlocked slowdown gear train.

Also, date indication may move off a date window (not shown) formed on a dial plate when the date dial is caused to rotate due to applied external disturbance by an amount equivalent to the sum of meshing backlash caused in the respective members of the slowdown gear train, i.e., those from the date dial to the rotor.

SUMMARY OF THE INVENTION

The present invention has been conceived to overcome the above problems and aims to provide an electronic timepiece having a calendar advancement device capable of correcting a date dial in a short time, and resistant to external shock.

In order to achieve the above objects, according to one aspect of the present invention, there is provided an electronic timepiece having a date dial as a rotating indication panel for dates on a calendar, comprising: a calendar advancement device, including a 24-hour switch for generating a date dial drive signal for every twenty-four hours; a date dial advancement transducer activated by a control circuit having received the date dial drive signal; and a date advancement mechanism having a date dial stabilizing Geneva wheel, and a date dial driving wheel for engagement with a flange of the Geneva wheel and a date wheel gear of the date dial, and being activated with force from the date dial advancement transducer.

With the above arrangement, the Geneva wheel is rotated quickly by the date dial advancement transducer to update dates so that a date change time and chance for erroneous operation of the date dial due to external shock can be reduced.

Also, the above electronic time piece may further comprise a detection mechanism for detecting start to advance the date dial; a counter circuit for counting for a predetermined amount of time in response to a signal from the detection mechanism; and a control circuit for suspending the date dial advancement transducer based on an output from the counter circuit to thereby suspend rotation of the date dial stabilizing Geneva wheel.

With the above arrangement, a constant stop position for the Geneva wheel can be achieved using the counter circuit. This can ensure stabilization of the date dial.

Further, in the above electronic timepiece, a feed tooth of the date dial stabilizing Geneva wheel may be located in a region opposite from the date dial driving wheel when the date dial is in a stabilized state.

With the above arrangement, the date dial can be further stabilized, and movement of the date dial in forward or backward direction can be handled in a similar manner.

Still further, the above electronic timepiece may further comprise a control circuit for fast-forward-rotating the date dial advancement transducer during a period from activation of the date dial advancement transducer to at least abutment of a feed tooth of the date dial stabilizing Geneva wheel on teeth of the date dial driving wheel.

With the above arrangement, time without load can be reduced so that a date change time can be further reduced. Also, movement of the date dial can be easily assured when the transducer is not rotated quickly.

Still further, the above electronic timepiece may further comprise a control circuit for fast-forward-rotating the date dial advancement transducer for correction of the calendar during a period from activation to stoppage of the date dial advancement transducer.

With the above arrangement, correction can be more quickly achieved.

Still further, it is possible to configure the above electronic timepiece so that abutment of the feed tooth of the date dial stabilizing Geneva wheel on the teeth of the date dial driving wheel is judged from a number counted by the counter circuit.

With the above arrangement, the need for any special abutment detection mechanism other than a counter circuit can be eliminated.

Still further, in the above electronic timepiece, abutment of the feed tooth of the date dial stabilizing Geneva wheel on the teeth of the date dial driving wheel may be detected from a signal from a detection mechanism for detecting start to advance the date dial.

With the above arrangement, operation can be carried out at reliable timing.

Still further, in the above electronic timepiece, the detection mechanism for detecting start to advance the date dial may have a pattern provided on the date dial and a photo sensor for detecting the pattern.

With the above arrangement, there is provided a prompt and sensitive detection mechanism.

Still further, in the above electronic timepiece, the detection mechanism for detecting start to advance the date dial may have a load detection circuit for detecting load on a drive circuit for the date dial advancement transducer.

With the above, a simpler structure can be achieved.

It is also possible to configure the above electronic timepiece such that the feed tooth of the date dial stabilizing Geneva wheel is held in a position, when the date dial is in a stabilized state, which is determined according to a ratio between forward and backward rotation speeds of the date dial advancement transducer so that the correcting of the date dial starts after a substantially same amount of time through either forward or backward rotation.

With the above arrangement, movement of the date dial can be corrected in the same time period through forward or backward rotation.

According to another aspect of the present invention, there is provided an electronic timepiece having a date dial as a rotating indication panel for dates on a calendar, comprising: a control device for dates on a calendar, including a date advancement transducer for driving a date dial; a slow-down gear train for transmitting rotation force of the date advancement transducer to the date dial; a date dial intermittent rotation drive device constituting a part of the slow-down gear train, for intermittently driving the date dial; and a bounding restraint lever for restraining rotation of the date dial in a non-driven state, and releasing rotation restraint on the date dial in a driven state.

With the above arrangement, date dial correction can be achieved in a short time, and the timepiece is more resistant to shock.

Also, in the above electronic timepiece, the bounding restraint lever may be engaged with teeth of the date dial in a non-driven state for rotation restraint, and departs from the teeth of the date dial in a driven state for releasing load due to pressing force applied to the date dial.

With the above arrangement, the timepiece is highly resistant to shock.

Further, the above electronic timepiece may be configured such that the date dial intermittent rotation device includes a date dial driving wheel arranged for engagement with the date dial all the time, a date intermediate wheel having feed teeth for intermittent engagement with the date dial driving wheel, and an eccentric cum for engagement with and rotating the bounding restraint lever, the date intermediate wheel and the eccentric cum having a common rotation center.

With the above arrangement, the bounding restraint lever can be reliably rotated.

Still further, in the above electronic timepiece, a bearing is provide between the eccentric cum and the feed teeth, for receiving an axis of the date intermediate wheel, and, the bounding restraint lever, the eccentric cum, the teeth of the date dial for engagement with the date dial driving wheel are provided on a same plane surface.

With the above, reduction of a correction time for the date dial, and a thin shock-resistive mechanism can be achieved.

According to the above described aspect of the present invention, the date dial is held still a under consistent stabilized condition when it is in a non-driven state (a normal operation) because the date bounding controlling part constrains rotation of the date dial. On the other hand, when the date dial is in a driven state (date change) only a small rotation load torque due to the date dial is applied to the step motor because the date dial is rotated after rotation restraint applied by the date bounding restraint part to the date dial is lifted. In this way, an electronic timepiece with a calendar in stabilized operation condition is provided.

BRIEF DESCRIPTION OF THE DRAWINGS

The above and other objects, features, and advantages of the present invention will become further apparent from the following description of the preferred embodiment taken in conjunction with the accompanying drawings wherein.

DESCRIPTION OF THE PREFERRED EMBODIMENTS

In the following, preferred embodiments of the present invention will be described with reference to the accompanying drawings.

Figure 1:
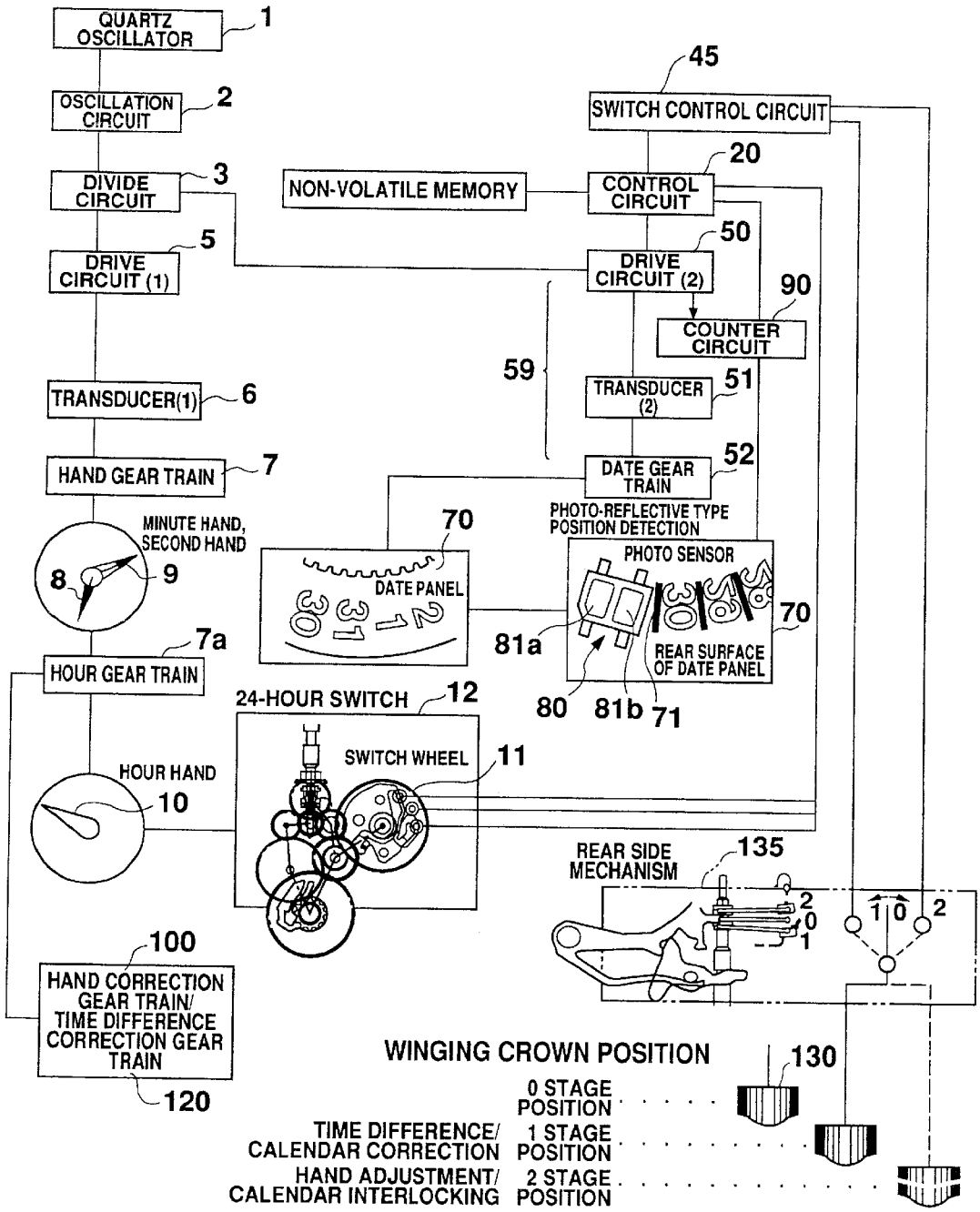
FIG. 1 is a conceptual diagram relative to an electric timepiece having a calendar advancement device according to the present invention.
Figure 2:
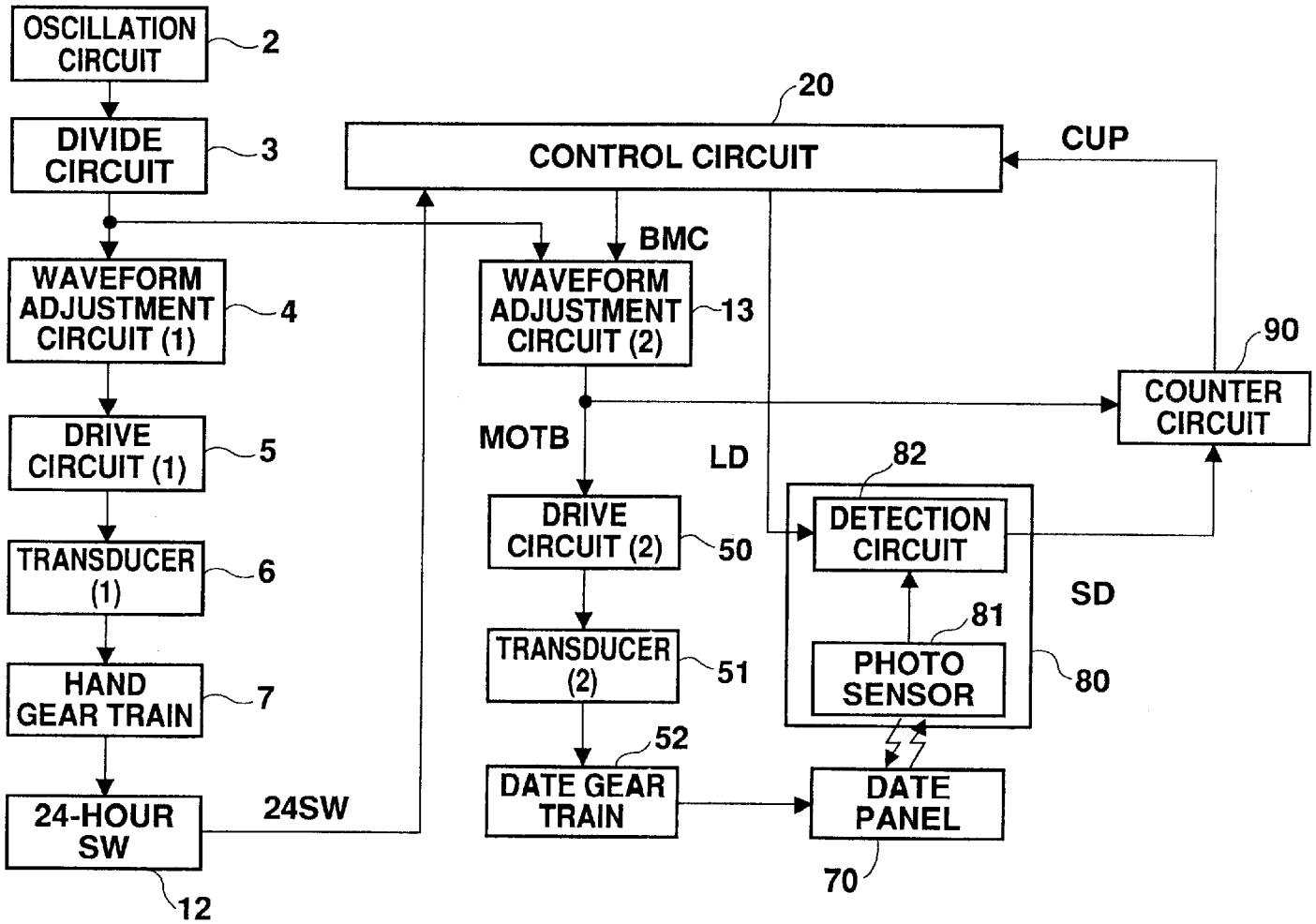
FIG. 2 is a block diagram showing a circuitry structure of the electronic timepiece shown in FIG. 1.

FIG. 1 is a conceptual diagram showing a structure of an electronic timepiece having a calendar advancement device according to the present invention. FIG. 2 is a block diagram showing a circuitry structure of the electronic timepiece shown in FIG. 1. In these drawings, a signal from an oscillation circuit 2 for oscillating a quartz oscillator 1 is divided into 1 Hz in the divide circuit 3, and the waveform thereof is adjusted in a waveform adjustment circuit (1) 4 (not shown in FIG. 1) before the signal is supplied to a drive circuit (1) 5 for driving a transducer (1) 6, which comprises a step motor in this embodiment. In response to a signal from the drive circuit (1) 5, the transducer (1) 6 is driven every second. Rotation force generated by the transducer (1) 6 is transmitted to a hand gear train 7, rotating a second hand 8 and a minute hand 9. Further, an hour gear train 7*a*, which is a part of the hand gear train, rotates an hour hand 10 and further a switchwheel 11, which makes one complete rotation for twenty-four hours, to turn on an 24-hour switch 12 every twenty-four hours.

The 24-hour switch 12 outputs a date dial drive signal 24SW for driving the date dial 70 to a control circuit 20.

In response to the signal 24SW, the control circuit 20 supplies a command signal (a date dial drive signal) BMC for driving the date dial 70 to a waveform adjustment circuit (2) 13 (not shown in FIG. 1). The waveform adjustment circuit (2) 13, which also receives a signal from the divide circuit 3, adjusts waveform of a signal from the divide circuit 3 based on the date dial drive signal BMC, and outputs a resultant signal as a drive signal MOTB to a drive circuit (2) 50. The drive circuit (2) 50 then drives a transducer (2) 51, which comprises a step motor in this embodiment. The transducer (2) 51 drives a date gear train 52, which in turn drives the date dial 70. In this embodiment, the date gear train 52 constitutes a date advancement mechanism.

Besides a date dial drive signal BMC, the control signal 20 outputs a drive signal LD to a photo sensor mechanism 80.

The photo sensor mechanism 80 comprises a photo sensor 81 and a detection circuit 82, the former including a light emitter 81*a* and a light receiver 81*b*.

The date dial 70 has a detection pattern 71, which includes a reflective part and a non-reflective part, printed on the rear surface thereof, and is used in detection of the start of advancing the date dial 70. The photo sensor mechanism 80 reads a boundary in the detection pattern 71 according to the movement of the date dial 70, and outputs a detection signal SD to the counter circuit 90.

In response to the detection signal SD, the counter circuit 90 begins counting a drive signal MOTB, and, after having counted for a predetermined time, supplies a count up signal CUP to the control circuit 20. In response to the count up signal CUP, the circuit 20 suspends output of a date dial drive signal BMC.

Referring to FIG. 1, a hand correction gear train 100 and a time difference correction gear train 120 are connected to an hour gear train 7*a*. The drawing also schematically shows a winding crown 130 set in zero, first, and second stage positions by a setting mechanism 135 so that a signal corresponding to each position is accordingly sent to a switch control circuit 45.

One preferred embodiment of a detection pattern 71 will next be described referring to FIG. 3.

Figure 3:
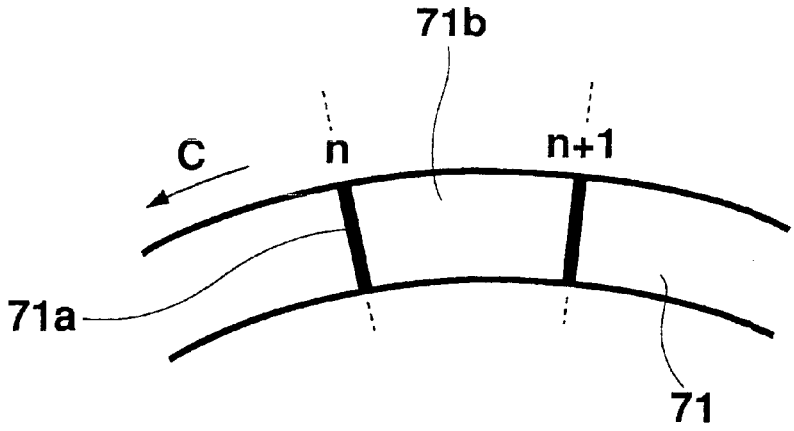
FIG. 3 is a conceptual diagram showing a detection pattern of an electronic timepiece according to the present invention.

FIG. 3 is a conceptual diagram showing a detection pattern on the rear surface of a date dial, in which a black part is a non-reflective part 71*a*, a white part is a reflective part 71*b*, and n and n+1 lines define an interval for one-day date indication.

When the data panel 70 is in a stabilized state (a normal state), the date dial 70 is positioned such that the middle part (indicated by the dotted line) of the n or n+1 line of the detection pattern 71 is positioned under the center of the detector of the photo sensor 81. Non-reflective parts, corresponding to the n or n+1 line, for thirty-one days are provided on the date dial 70. In the drawing, the arrow C indicates the rotation direction.

Referring to the middle left of FIG. 1, positional relationship between the detection pattern 71 on the rear surface of the date dial 70 and the photo sensor 81 is conceptually shown.

Figure 4:
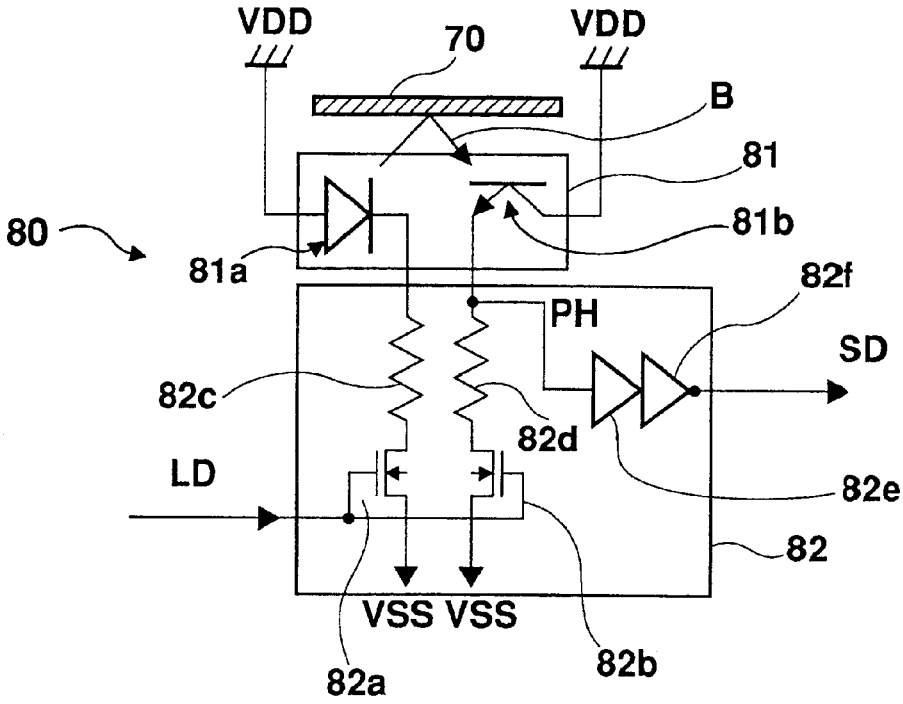
FIG. 4 is a circuitry diagram showing a photo sensor mechanism for use in an electronic timepiece according to the present invention.

FIG. 4 is a diagram showing an internal circuit of a photo sensor mechanism 80, which comprises a photo sensor 81 and a detection circuit 82.

In response to a signal 24SW from the 24-hour switch 12, the control circuit 20 drives, via a drive signal LD for the photo sensor mechanism 80, FETs 82*a*, 82*b* of the detection circuit 82. Then, electric current flows from the level VDD through the light emitter 81*a* of the photo sensor 81 and the resistance 82*c* to the level VSS, whereby light B is emitted. When the light B is reflected on the rear surface of the date dial 70, the reflected light reaches and thereby activates the light receiver 81*b*. Thereupon, electric current flows from the level VDD through a detection resistance 82*d* and FET 82*b* to the level vss, so that an H-level signal PH is supplied via the detection resistance 82*d* to a comparator 82*e*. After inversion in an inverter 82*f*, the detection circuit 82 outputs the signal as an L-level detection signal SD. On the other hand, in the case where the light 8 irradiates a non-reflective part on the date dial 70, and thus is not reflected, the light receiver 81*b* is not activated. Therefore, an H-level detection signal SD is output.

Figure 5:
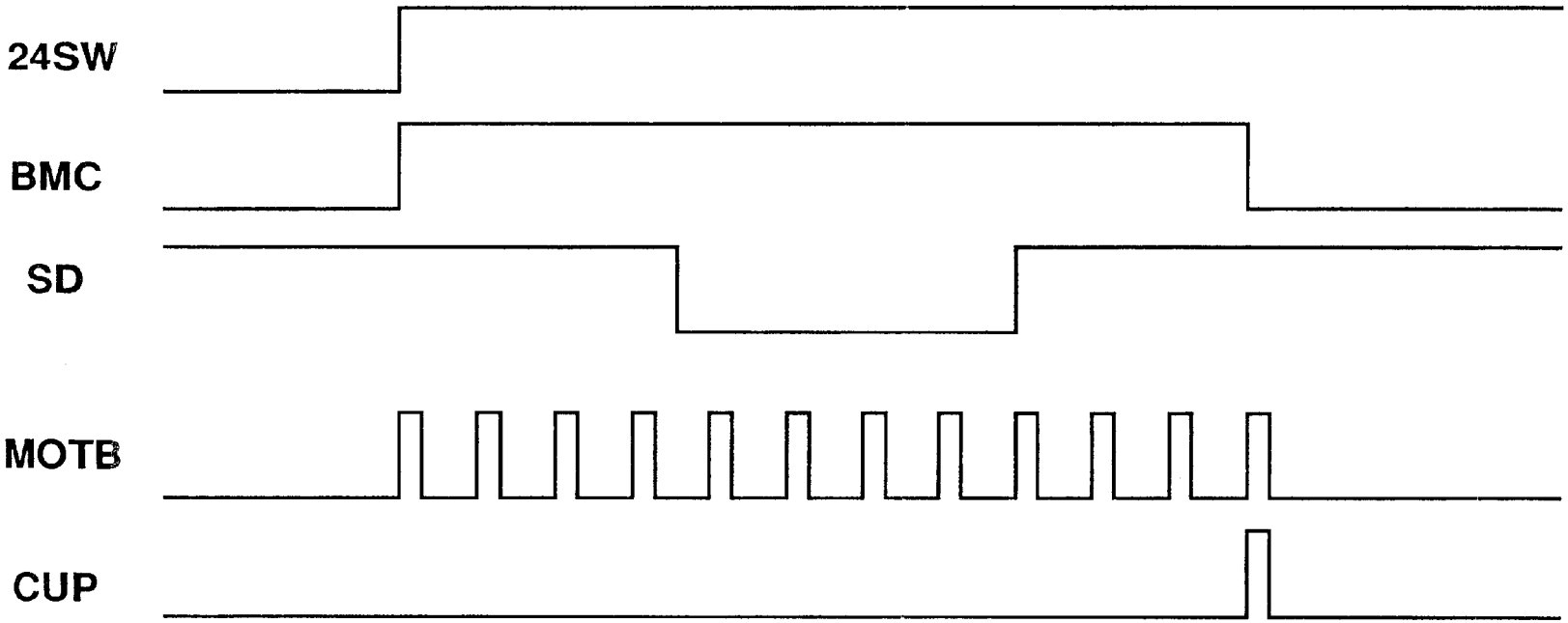
FIG. 5 is a diagram showing waveforms of signals generated by a circuit of the electronic timepiece shown in FIG. 2.

FIG. 5 is a diagram showing waveforms of the signals generated by the circuit of an electric timepiece shown in FIG. 2.

When a date dial drive signal 24SW becomes H level, a date dial drive signal BMC from the control circuit 20 also becomes H level.

Then, the waveform adjustment circuit (2) 13 outputs a drive signal MOTB for driving the transducer (2) 51, upon which the transducer (2) 51 begins rotating, thereby rotating the date gear train 52.

As the date dial 70 accordingly begins rotating, the detector of the photo sensor 81 of the photo sensor mechanism 80 resultantly moves from a non-reflective part to a reflective part of the detection pattern 71 on the date dial 70, as a result of which an L-level detection signal SD is output.

With an L-level detection signal SD is output, the counter circuit 90 begins counting drive signals MOTB. Having counted a predetermined number of signals MOTB, the counter circuit 90 outputs a count up signal CUP, in response to which the date dial drive signal BMC becomes L-level. As a non-reflective part of the detection pattern 71 (e.g., the n+1 part shown in FIG. 3) is then positioned below the photo sensor 81 when the date dial 70 stops rotating, a detection signal SD becomes H-level.

Next, positional relationship among the transducer (2) 51, the date gear train 52 as a date advancement mechanism, and a date dial 70 will be described.

Figure 6:
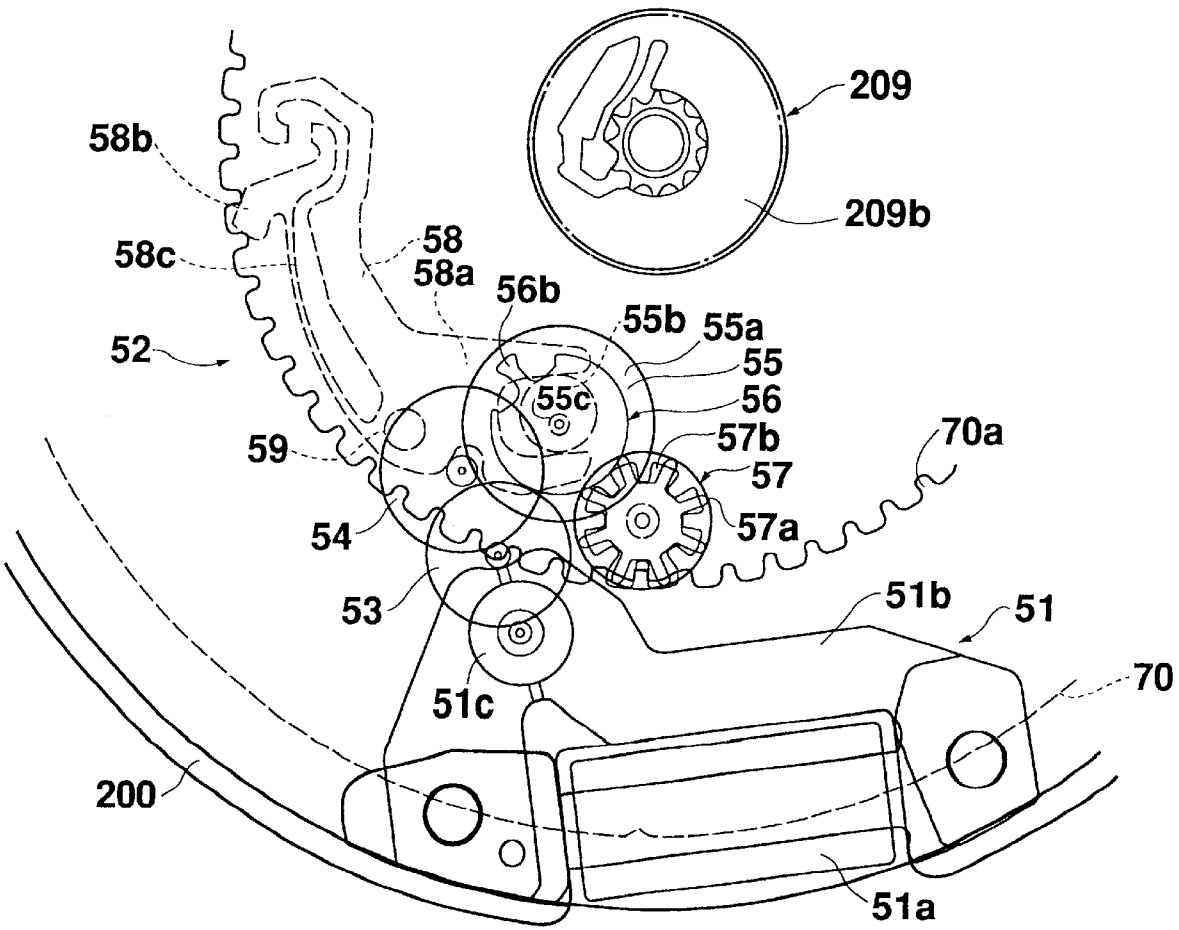
FIG. 6 is a diagram showing partial positional relationship among movements of the electronic timepiece shown in FIGS. 1 and 2 of the present invention viewed from the above of the timepiece.

FIG. 6 is a diagram showing partial positional relationship among movements of a timepiece viewed from the above (the rear side surface).

In the following, a mechanical structure and operation of the above described preferred embodiment will be described in detail.

Figure 7:
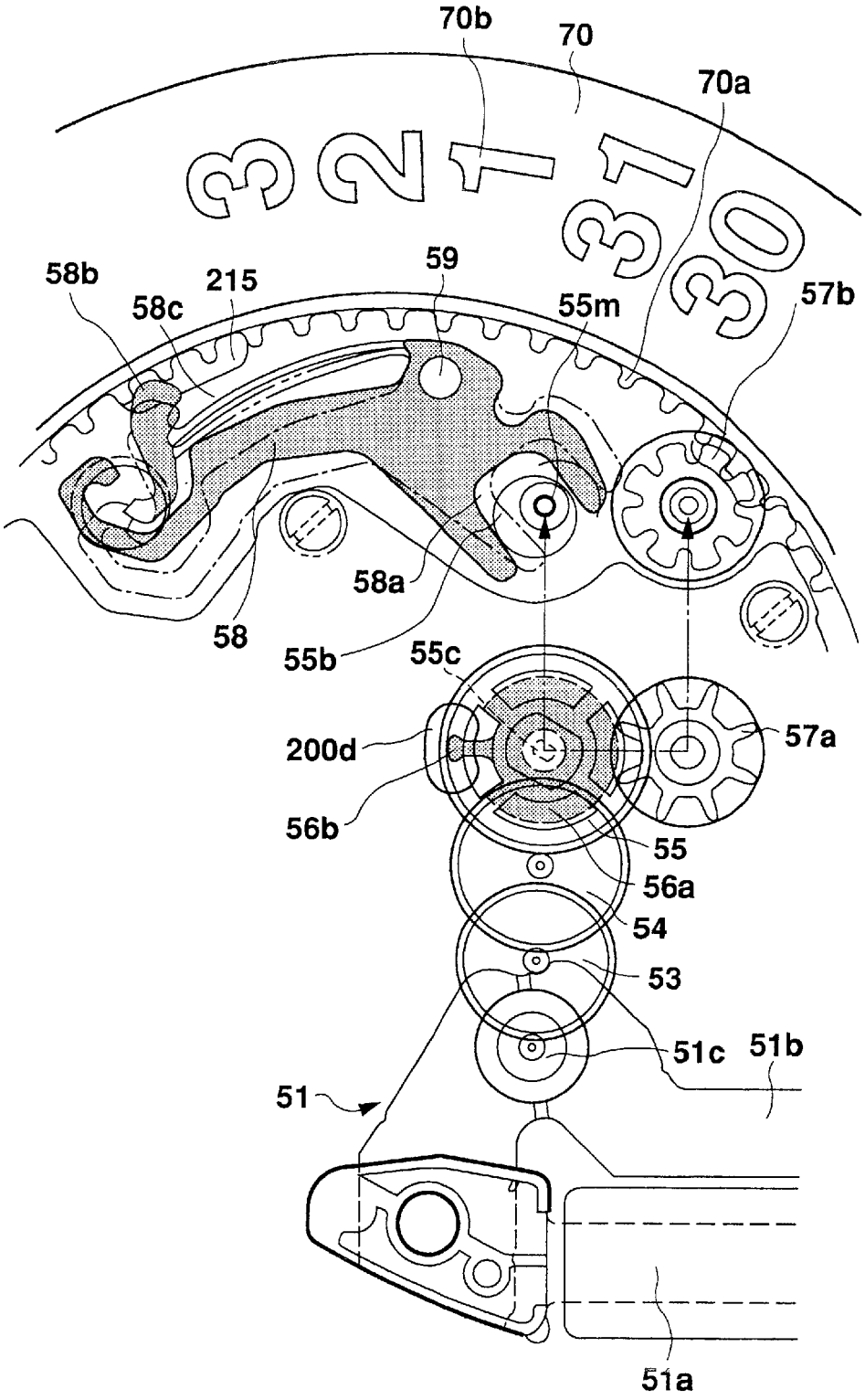
FIG. 7 is a diagram showing partial positional relationship among movements of a timepiece, corresponding to FIG. 6, viewed from the below of the timepiece, different from FIG. 6.

FIG. 7 is a diagram showing partial positional relationship among timepiece movements, in particular, a part of a date advancement transducer (a date step motor) and a date gear train (a date drive gear train) viewed from the below of the timepiece, different from FIG. 6. In the drawing, respective movements are shown displaced from one another for convenience in explanation of their arrangement.

Also, components of a date intermediate wheel (3) 55 and a date dial driving wheel 57 are shown separated for easy understanding of the drive force transmission path for the date intermediate wheel (3) 55, the date dial driving wheel 57, an eccentric cam 55*b*, and the date dial 70. That is, the arrow of a dotted line drawn from the date intermediate wheel (3) 55 to the eccentric cam 55*b*, and that from the intermediate date wheel gear 57*a* to the date dial driving wheel gear 57*b* represent drive force transmission paths. Drive force is transmitted by the eccentric cam 55*b* and the date intermediate wheel axis 55*c* together making one complete rotation, and the date dial driving wheel gear 57*b* and the intermediate date wheel gear 57*a* together making one complete rotation.

Figure 8A:
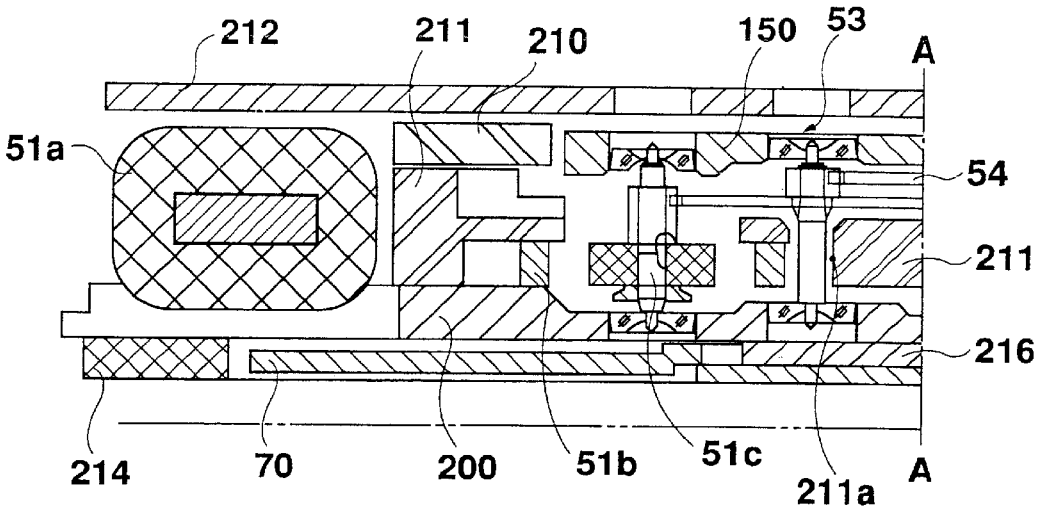
FIGS. 8*a* and 8*b* provide a cross sectional diagram of the movement of a timepiece along the date dial advancement transducer, the date gear train, and the date dial shown in FIG. 6, the drawing being shown divided into two pieces for convenience along the line A—A.
Figure 8B:
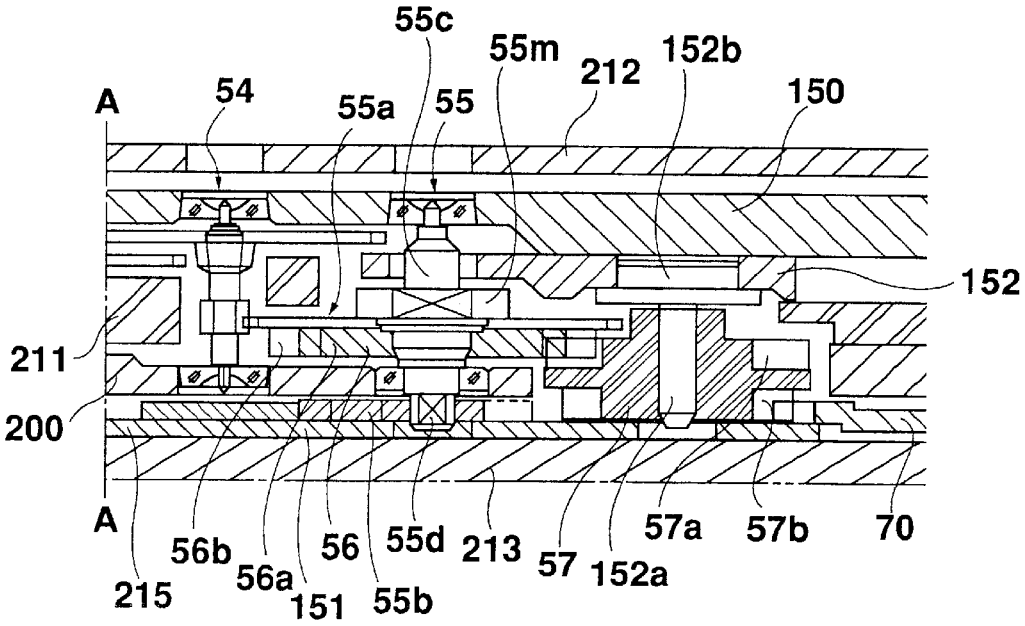

FIG. 8 is a cross sectional view along the transducer (2) 51, the date gear train 52, and the date dial 70 shown in FIG. 6, the view being divided in two pieces for convenience along the dotted line A—A.

Referring to FIGS. 6 through 8, the date rotor 51*c* and the date gear train 52 are basically held on the base plate 200 and a gear train bridge 150. The date coil 51*a* and the date stator 51*b* of the transducer (2) 51 are held via a screw (not shown) on the base plate 200.

The date dial driving wheel 57 is held on a pin 152*a* formed on an center wheel cock 152, and abutted by the date dial guard 151 on one side.

Note that the drawing also shows a circuit substrate 210, a circuit support plate 212, a dial plate 213, and a dial plate receiving ring 214.

A date intermediate wheel axis 55*c*, a part of the date intermediate wheel (3) 55, pierces the center wheel cock 152, with lower and upper tenons thereof being axially held by the bearing and by the bearing of the gear train bridge 150, respectively. Below the lower surface of the center wheel cock 152, a middle shoulder part is provided having a maximum diameter and a two-face-cut part formed on the external circumference thereof.

Below the middle shoulder part, a date intermediate wheel gear 55*a* is press-fit for receiving rotation force of the date intermediate wheel (2) 54, and a Geneva wheel 56 is press-fit below the wheel gear 55*a*. The lower axial portion below the lower tenon of the date intermediate wheel axis 55*c*, which projects towards the dial plate 213 side, has a two-face-cut part 55*d* formed thereon to be engaged with a D-cut hole of the eccentric cam 55*b* for receiving rotation force.

As the eccentric cam is engaged with the axial tip of the lower tenon of the date intermediate wheel axis 55*c*, which is axially held by the gear train bridge and the bearing of the base plate, there can be provided a stable date dial control mechanism which is less affected by the pressing force applied by the bounding restraint lever which restrains rotation of the date dial. (For example, reaction of the pressing force applied by the bounding restraint lever to date dial, which is engaged with the lever via the teeth thereof, may act as a couple force on the bearing of the date intermediate wheel gear via the eccentric cam, increasing friction on the bearing and affecting rotation force of the date step motor which drives the date intermediate wheel (3) 55.)

The two-face-cut part on the part having the largest diameter of the date intermediate wheel axis 55*c* is formed in the same direction as that for the two-face-cut part formed on the lower axial part of the date intermediate wheel axis 55*c*. Therefore, for assembling the date intermediate nail (Geneva wheel) 56 to the date intermediate wheel axis 55*c* through press-fitting, the two-face-cut part on the largest diameter part of the wheel axis 55*c* is initially positioned by using a tool such that the two-face-cut part on the lower axial part is substantially matched with the feed tooth (finger part) 56*b* so that the Geneva wheel 56 is assembled such that the finger part 56*b* thereof can be easily set accordingly. With this arrangement, the finger part 56*b* can be positioned substantially matched with the eccentric cam 55*b* for synchronizing operation of the date dial intermittent rotation drive device and the bounding restraint lever 58, and the date dial 70 can be set free from the pressing force applied by the date bounding controlling part 58*b* when the date dial 70 is driven. Further, an eyehole 200*d* (see FIG. 7) is formed on the base plate 20, through which the position of the finger part 56*b* can be assured when assembling the eccentric cam 55*b* from the dial plate 213 side into the two-face-cut part on the lower axis in accordance with the position of the finger part 56*b*. With provision of the eyehole 200*d*, error assembly of the eccentric cam 55*b* can be avoided. (The eccentric cam 55*b* can be assembled in two different plane positions, and, with an erroneously assembled eccentric cam 55*b*, pressing force applied to the driven date dial 70 by the bounding restraint part 58*b* could not be released.)

A center wheel cock 152 is provided in a cross sectional hollow part in the base plate 200 and the gear train bridge 150, for axially supporting other gear train mechanisms (not shown), and a date dial driving wheel axis 152*a* is formed on the center wheel cock 152. The date dial driving wheel 57 is assembled from the dial plate 213 side such that its surface on the intermediate date wheel gear 57*a* side faces the date dial driving wheel axis 152*b*, and is pressed and held by the date dial guard 151 on its side, i.e., the side with the date dial driving wheel gear 57*b* of the date dial driving wheel 57.

An engagement position between the date dial driving wheel gear 57*b* and the teeth 70*a* of the date dial 70, the eccentric cam 55*b*, and the bounding restraint lever 58 are arranged within a space equivalent to the thickness of the thin rear plate 216, which is provided in the hollow parts in the base plate 200 and the date dial guard 151.

Winding stem spacers 211 are provided on the upper surface of the date stator 51*b* and the date intermediate wheel (3) 55, and in a cross sectional hollow part in the base plate 200 and the center wheel cock 152, and a guide hole 211*a* is formed on the winding stem spacer 211, for preventing falling down of these members when assembling.

When the 24-hour switch 12 is switched on, the control circuit 20 outputs a drive signal BMC for the transducer (2) 51, in response to which the drive circuit (2) 50 drives the transducer (2) 51. The transducer (2) 51 is a step motor which comprises a date coil 51*a*, a date stator 51*b*, and a date rotor 51*c* in this embodiment. Rotation of the date rotor 51*c* is transmitted, while being decelerated, to the date intermediate wheels (1) 53, (2) 54, (3) 55. The date intermediate wheel (3) 55 comprises a gear 55*a* and a Geneva wheel 56, which are fixedly formed integrated with the date intermediate wheel axis 55*c*, the Geneva wheel 56 including the flange 56*a* and a feed tooth (date intermediate nail) 56*b*. Engaged with the date intermediate wheel axis 55*c* of the date intermediate wheel (3) 55 on the side other than that with the date intermediate nail 56, i.e., the Geneva wheel 56 here, with respect to the base plate 200 is an eccentric cam 55*b*. The D-cut part of the date intermediate wheel axis 55*c* is fit into the D-cut hole on the eccentric cam 55*b*.

Generally, the Geneva wheel 56 makes one complete rotation every day, with rotation force applied by the transducer (2) 51 via the feed tooth thereof the intermediate date wheel gear 57*a* of the date dial driving wheel 57 so that the date dial driving wheel gear 57*b*, integrated with the wheel gear 57*a*, can advance the date wheel gear 70*a* of the date dial 70 once a day. In general, the Geneva wheel 56 is positioned such that the flange 56*a* thereof contacts two teeth of the intermediate date wheel gear 57*a* so that the date dial driving wheel 57 is blocked from rotating. A date gear train 52 here is the gear train consisting the respective members from the date intermediate wheel (1) 53 to the date dial driving wheel 57.

The bounding restraint lever 58 is supported on the base plate 200 with the bounding restraint lever pin 59 as the rotation center. The eccentric cam 55*b*, engaged with a fork part 58*e*, or a cut-in part, of the bounding restraint lever working part 58*a* of the bounding restraint lever 58, serves to change deflection of the bounding restraint spring 58*c*, which supports the date bounding restraint part 58*b* meshed with the date wheel gear 70*a*, and moves the date bounding restraint part 58*b* away from the date wheel gear 70*a*. Extended parts of the date bounding restraint part 58*b* and the rigid part 58*d* are formed by-means of shirring, and cut apart. The bounding restraint lever 58 is formed such that the date bounding restraint part 58*b* is integrated with the bounding restraint spring 58*c*. While the feed tooth 56*b* advances the date dial driving wheel 57, the deflection of the bounding restraint spring 58*b* is kept small or the date bounding restraint part 58*b* is kept away from the date wheel gear 70*a* so as to maintain small energy for advancing the date dial 70. The bounding restraint lever 58 is positioned as indicated by the dot line in FIG. 7 when advancing the date dial 70.

When the date dial 70 is in a non-driven state in normal operation, the bounding restraint lever 58 is positioned as indicated by the solid line in FIG. 7. The cut-apart part of the date bounding restraint part 58*b* is then open with the bounding restraint spring 58*c* being elastically deformed. On the other hand, when the date dial 70 is driven around 0 o'clock midnight for date change, the bounding restraint lever 58 is in a position indicated by the two-dot and dash line in FIG. 7, with the cut-apart part being closed as it is formed through shirring.

As described above, the transducer (2) 51 is activated for every turning of the 24-hour switch 12, and the date gear train 52 advances the date dial 70 for one day.

Note that the rotating plate for date indication, or the date dial 70, is a thin ring plate with dates from 1 to 31 printed on its surface. Along the inside circumference of the date dial 70, 62 teeth 70*b* (two teeth for one-day advancement) are formed in an integrated manner.

In normal operation (at times other than date change), the intermediate date wheel gear 57*a* is engaged via two teeth thereof with the side surface of the flange 56*a* of the Geneva wheel 56 for rotation restraint, and the date dial 70 is engaged via one tooth of the date wheel gear 70*a* thereof with two teeth of the date dial driving wheel gear 57*b* for rotation restraint.

During date change, the feed tooth 56*b* and one of the two shoulders of the Geneva wheel 56 together advance the intermediate date wheel gear 57*b* by two teeth, thereby rotating the data panel 70 by two teeth.

The eccentric cam 55*b* has a D-cut part, or the round hole for a rotation center cut to have two line edges, and the D-cut hole receives the D-cut part of the date intermediate wheel axis 55*c*.

Figure 9:
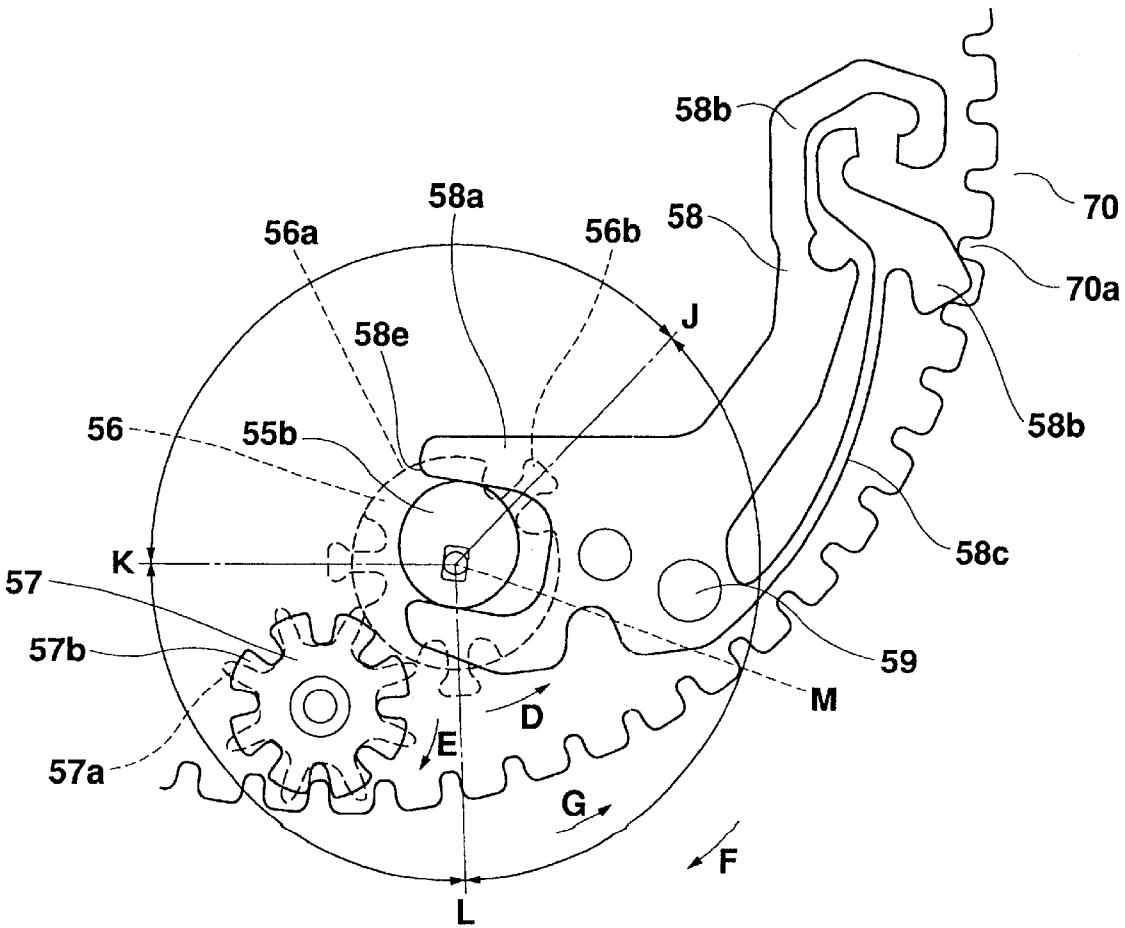
FIG. 9 is an enlarged diagram showing a Geneva wheel and its surrounding members viewed from the below of a timepiece for explaining positional relationship among the respective members.

FIG. 9 is a diagram for explaining arrangement of the Geneva wheel 56, the bounding restraint lever 58, the date dial driving wheel 57, and the date dial 70, and operation of the Geneva wheel 56. The drawing shows a part of the members shown in FIGS. 6 and 7, viewed from the bottom (the dial side) of a timepiece, different from FIG. 6 and similar to FIG. 7, in which identical members to those shown in FIGS. 6 and 7 are given identical reference numerals.

The Geneva wheel 56 is indicated by the dotted line. Reference J indicates a stop position where the feed tooth 56*b* of the Geneva wheel 56 is generally positioned when the Geneva wheel 56 stops rotating, in other words, until the transducer (2) 51 is driven in response to a signal 24SW from the 24-hour switch 12. When the date rotor 51*c* of the transducer (2) 51 begins rotating, the Geneva wheel 56, a part of the date gear train 52, begins rotating in the direction of the arrow D (forward direction) until the feed tooth 56*b* thereof arrives at the position K. With the feed tooth 56*b* in the position K, the teeth of the intermediate date wheel gear 57*a* are disengaged with the flange 56*a* of the Geneva wheel 56, upon which the date dial driving wheel 57 enters an advancement state. Meanwhile, the eccentric cam 55*b*, engaged with the date intermediate wheel axis 55*c* of the date intermediate wheel (3) 55, also begins rotating, and the bounding restraint lever 58 is thereby rotated around the bounding restraint lever pin 59, reducing the pressing force applied by the date bouncing restraint part 58*b* to the date gear wheel 70*a*. Thereafter, the feed tooth 56*b* of the Geneva wheel 56 abuts on the teeth of the intermediate date wheel gear 57*a* of the data rotation wheel 57, advancing the date dial driving wheel 57 in the direction with the arrow E. As the date dial driving wheel gear 57*b* of the date dial driving wheel 57 drives the date wheel gear 70*a*, the date dial 70 also begins rotating in the arrow F. Meanwhile, the date bounding restraint part 58*b* of the bounding restraint lever 58 temporarily departs from the date wheel gear 70*a*. At the beginning of advancing the date dial 70, the photo sensor mechanism 80 detects the detection pattern 71 on the rear surface of the date dial 70, and then outputs a detection signal SD. In response to the detection signal SD, the counter circuit 90 begins counting a drive signal MOTB.

The feed tooth 56*b* advances the intermediate date wheel gear 57*a* by two teeth and, as a consequence, also the date wheel gear 70*a* by two teeth. As a result, the date dial 70 has been advanced for one day. Thereafter, the date bounding restraint part 58*b* of the bounding restraint lever 58 is re-engaged with the date wheel gear 70*a* to restrain bounding of the date wheel gear 70*a*. When the feed tooth 56*b* has arrived at the position L, advancing the date dial 70 is completed.

The Geneva wheel 56 continues rotating until the counter circuit 90 has reached a predetermined number, and outputs a count up signal CUP. In response to the count up signal CUP, output of a drive signal BMC is suspended as described above, in response to which the transducer (2) 51 suspends operation, and the Geneva wheel 56 also suspend rotation.

By the completion of the above process, the feed tooth 56*b* has returned to the position J, where the Geneva wheel 56 is again in an await state. As the position J is located on the opposite side from the date dial driving wheel 57, as shown in FIG. 9, a stabilized state of the date dial 70 can be ensured.

When the date dial 70 is rotated backward, i.e., in the direction with the arrow G, for correction, the Geneva wheel 56 and the date dial driving wheel 57 rotate in the opposite directions from those with the arrows D and E, respectively, for reverse advancement.

With the date dial 70 in a stabilized state, the feed tooth 56*b* remains in an await position indicated by the dot line M in the drawing, the await position being determined in consideration of reverse correction. In a transducer using a step motor, a forward advancement speed is generally faster than a reverse advancement speed, the ratio of which is often 2:1. With such a ratio, in order to provide a user-friendly mechanism wherein correction can be started at the same time through either forward or backward rotation, the feed tooth 56*b* is preferably held in a position determined according to the ratio between the forward and backward rotation speeds of the transducer. The position indicated by the dot line M is a stop position for the feed tooth 56*b* in the case that the ratio between the forward and backward rotation speeds is 2:1. The stop position can be achieved by setting an appropriate number to be counted by the counter circuit 90.

Figure 10:
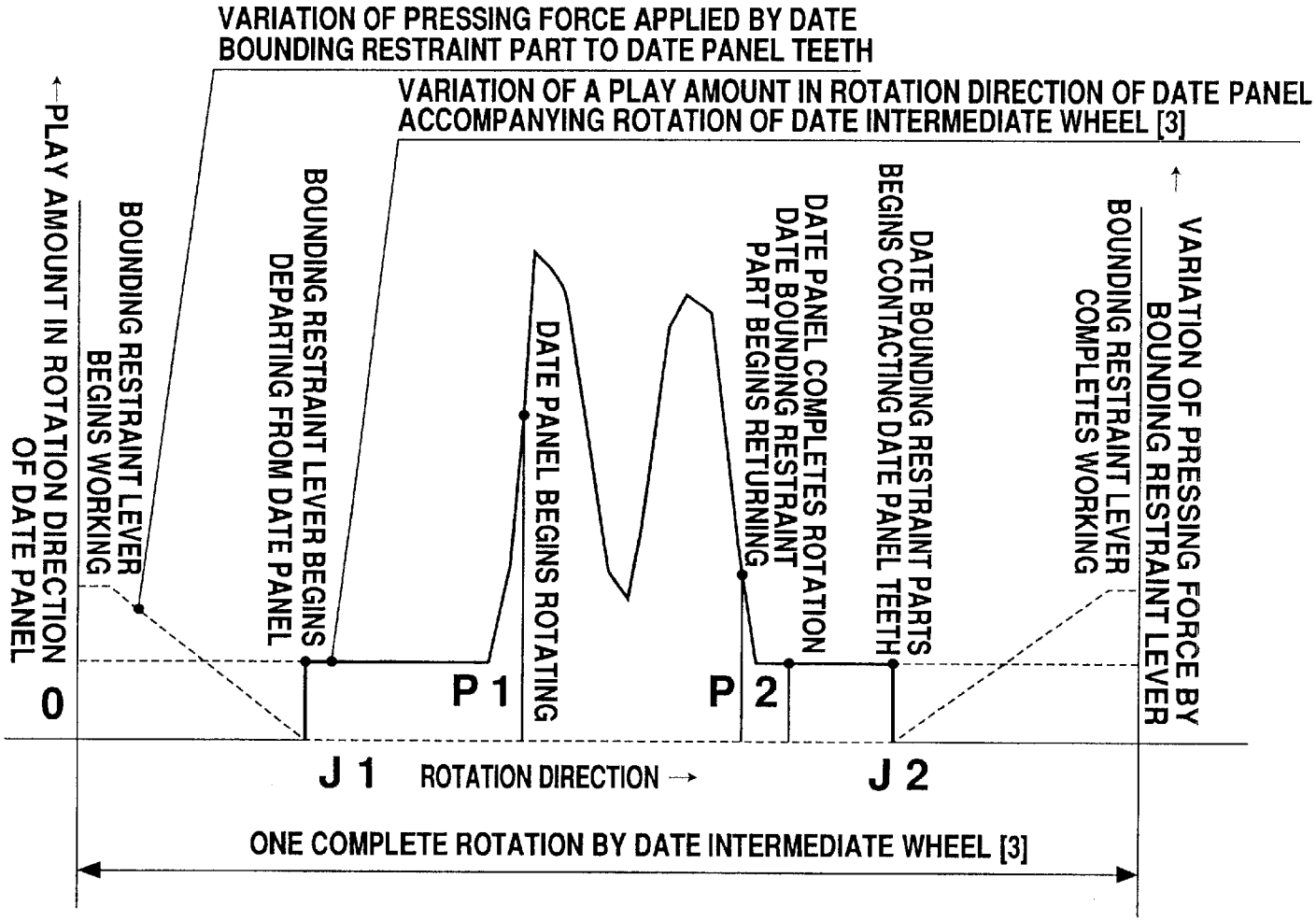
FIG. 10 is a diagram for explaining play in the rotation direction of the date dial and variation of pressing force applied by the date bounding restraint part to the teeth of the date dial during a period when the date intermediate wheel makes one complete rotation, the play being caused resulting from rotation of the date dial intermittent rotation drive device, such as a Geneva wheel.

Referring to FIG. 10, relationship between operation of the feed tooth 56*b*, which drives the date dial driving wheel 57 and the date dial 70 for intermitted rotation, and working timing of the bounding restraint lever 58 will be described.

The lateral axis in FIG. 10 corresponds to one complete rotation of the date intermediate wheel (3) 55. The graph of FIG. 10 shows a play amount in the rotation direction of the date dial and pressing force applied by the bounding restraint lever which are measured while rotating the date intermediate wheel (3) 55 by each predetermined amount. The solid line indicates variation of a play amount accompanying rotation of the date dial intermittent rotation drive device, and the thick broken line indicates variation of pressing force applied by the date bounding restraint part 58*b* of the bounding restraint lever 58 to the date wheel gear 70*a* of the date dial 70.

The term "rotation direction →" in FIG. 10 corresponds to the forward rotation direction of the date intermediate wheel (3) 55; the point J (see FIG. 9) corresponds to the right and left ends on the lateral axis; and the points K and L correspond to the points P1 and P2 on the solid line, respectively.

When the feed tooth 56 is at the point J, the bounding restraint lever 58 applies via the date bounding restraint part 58*b* thereof consistent pressing force to the date wheel gear 70*a* of the date dial 70.

As the date intermediate wheel (3) 55 in condition corresponding to the left end of FIG. 10 begins rotating, the eccentric cam 55*b* begins rotating in synchronism therewith, driving the bounding restraint lever 58. With the lever 58 being driven, the pressing force applied by the date bounding restraint part 58*b* decreases as depicted in FIG. 10 by the broken thick line slanting downward to the right, until the date bounding restraint part 58*b* departs from the date wheel gear 70*a* before the point P1 (Point J1 in FIG. 10).

By the time the eccentric cam 5O*b* has rotated from the normal stop position J by an amount corresponding to a half rotation by the feed tooth 56*b*, the date bounding restraint part 58*b* of the bounding restraint lever 58 will have been moved completely away from the rotation locus area of the date wheel gear 70*a* of the date dial 70, and the date dial 70 will have been released from the pressing force. The bounding restraint lever 58 is positioned as indicated by the two-dot and dash line in FIG. 7 resulting from rotation by a maximum amount.

In the above condition, the date dial 70 is engaged only with the date dial driving wheel gear 57*b*, and subjected to rotation restraint (i.e., in condition where some backlash is caused on the date wheel gear 70*a* of the date dial 70 and the date dial driving wheel gear 57*b*).

When the rotating date intermediate wheel (3) 55 has rotated passing the point P2, the bounding restraint lever 58 comes to be gradually driven by the rotating eccentric cam 55*b*, causing the date bounding restraint part 58*b* to contact again the date wheel gear 70*a* of the date dial 70 (Point J2 in FIG. 10). Accordingly, pressing force increases as the feed tooth 56*b* comes closer to Point J, where the pressing force is fully restored, as depicted in FIG. 10 by the broken thick line rising to the right.

When the date dial 70 begins rotating due to rotation of the date dial driving wheel 57*a* caused by the date intermediate wheel (3) 55, no pressing force is applied to the date dial 70 by the date bounding restraint part 58. Therefore, the transducer (2) (date step motor) 51 receives only a small rotation load torque from the rotating date dial 70. With the above arrangement, there can be provided a stable date driving mechanism, similar to a general step motor for hour indication.

Figure 11:
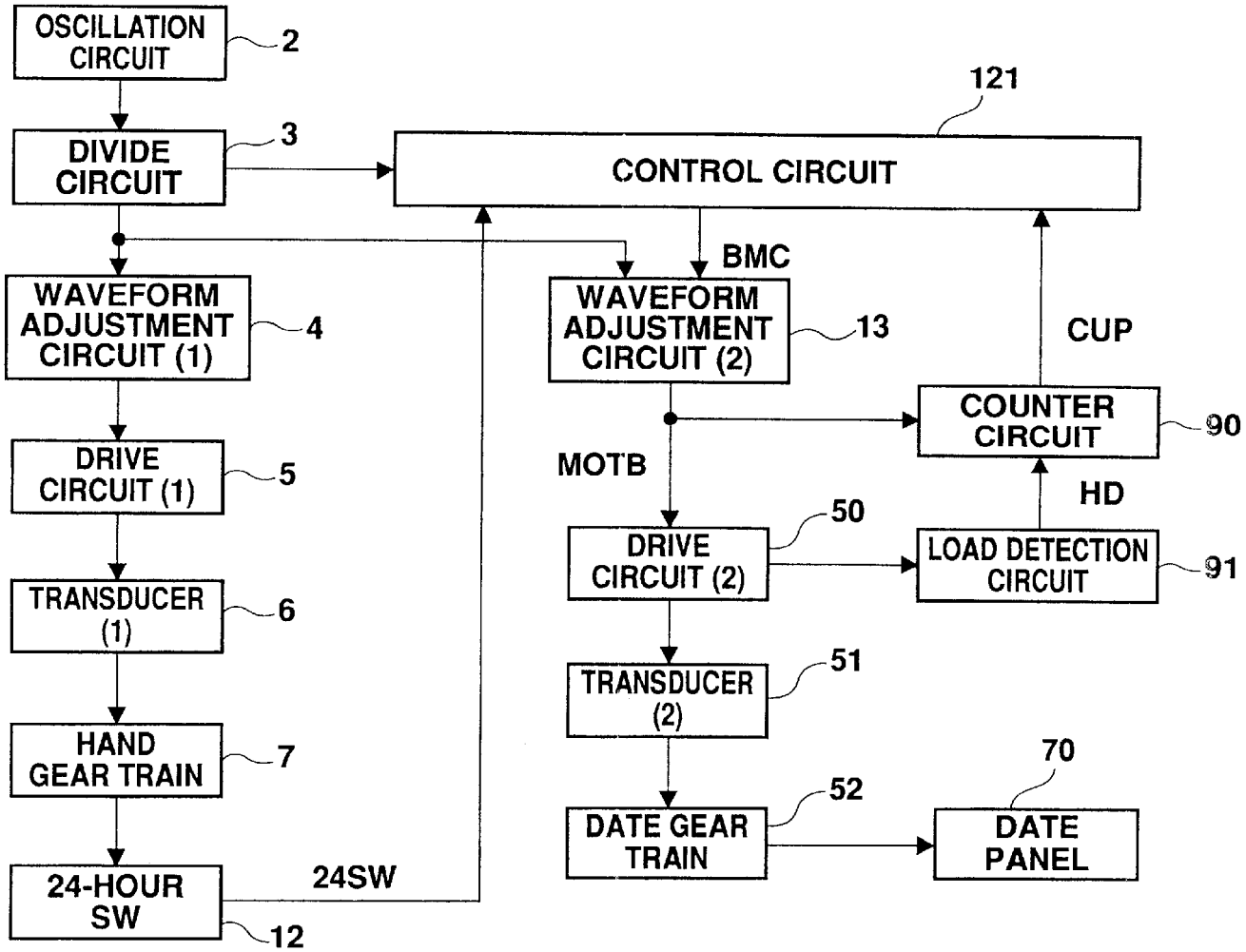
FIG. 11 is a block diagram showing circuitry structure, corresponding to FIG. 2, of another preferred embodiment of the present invention.
Figure 12:
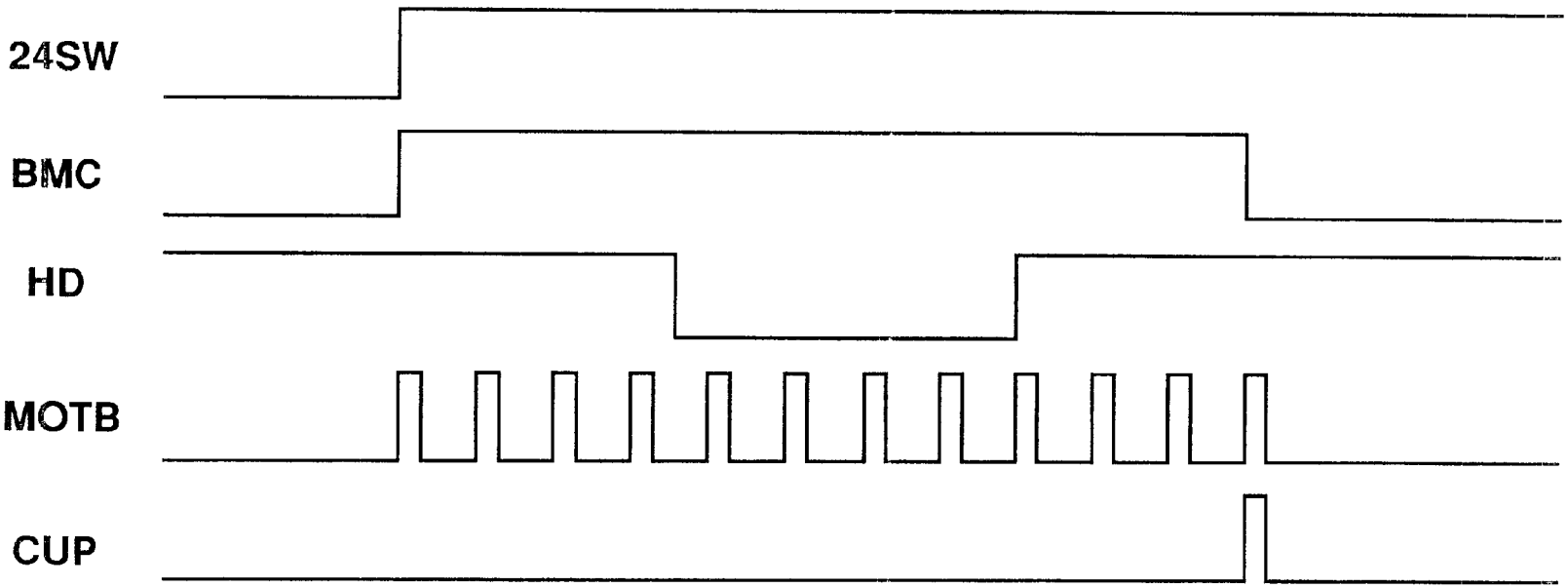
FIG. 12 is a diagram showing waveforms of signals generated by a circuit having the structure shown in FIG. 11.

Referring to FIGS. 11 and 12, a preferred embodiment of the present invention will be described in which load of the drive circuit (2)50 is detected for starting activation of the counter circuit 90.

FIG. 11 is a block diagram corresponding to FIG. 2 and showing a circuit structure of an electric timepiece according to the present embodiment, and in which respective elements are given reference numerals corresponding to those in FIG. 2. The circuit relative to FIG. 11 includes a load detection circuit 91 in the place of the photo sensor mechanism 80 in FIG. 2.

FIG. 12 shows waveforms of the signals generated by a circuit having the structure shown in FIG. 9.

In response to a date dial drive signal 24SW from the 24-hour switch 12, the control circuit 121 outputs a date dial drive signal BMC to the waveform adjustment circuit (2) 13. The waveform adjustment circuit (2) 13, also receiving a signal from the divide circuit 3, begins to output a drive signal MOTB. In response to the drive signal MOTB, the drive circuit (2) 50 drives the transducer (2) 51, the date gear train 52, and the date dial 70. As the date dial 70 begins rotating, a larger load is imposed. Variation of the load is detected by the load detection circuit 91, which then outputs a load detection signal HD. The load detection circuit 91 changes the signal HD from normal H level to L level when the load exceeds a predetermined amount. Based on the change of the load detection signal HD, the counter circuit 90 begins counting drive signals MOTB, and, when it has counted a predetermined number of signals MOTB, outputs a count up signal CUP to the control circuit 121. In response to the count up signal CUP, the control circuit 121 suspends output of the date dial drive signal BMC, and, as a consequence, output of the drive signal MOTB is also suspended.

In this embodiment, the stop position for the Geneva wheel can be controlled through provision of a simply-structured load detection circuit 91 in the place of the photo sensor mechanism 80, and the setting of an appropriate number to the counter circuit 90.

With this arrangement, in which change of the detection pattern according to the movement of the date dial, and change from mechanical change, such as change of load on a drive circuit, are detected so that the counter circuit can operate based thereupon, the feed tooth of the Geneva wheel can be properly returned to a temporal stop position and held there.

Figure 13:
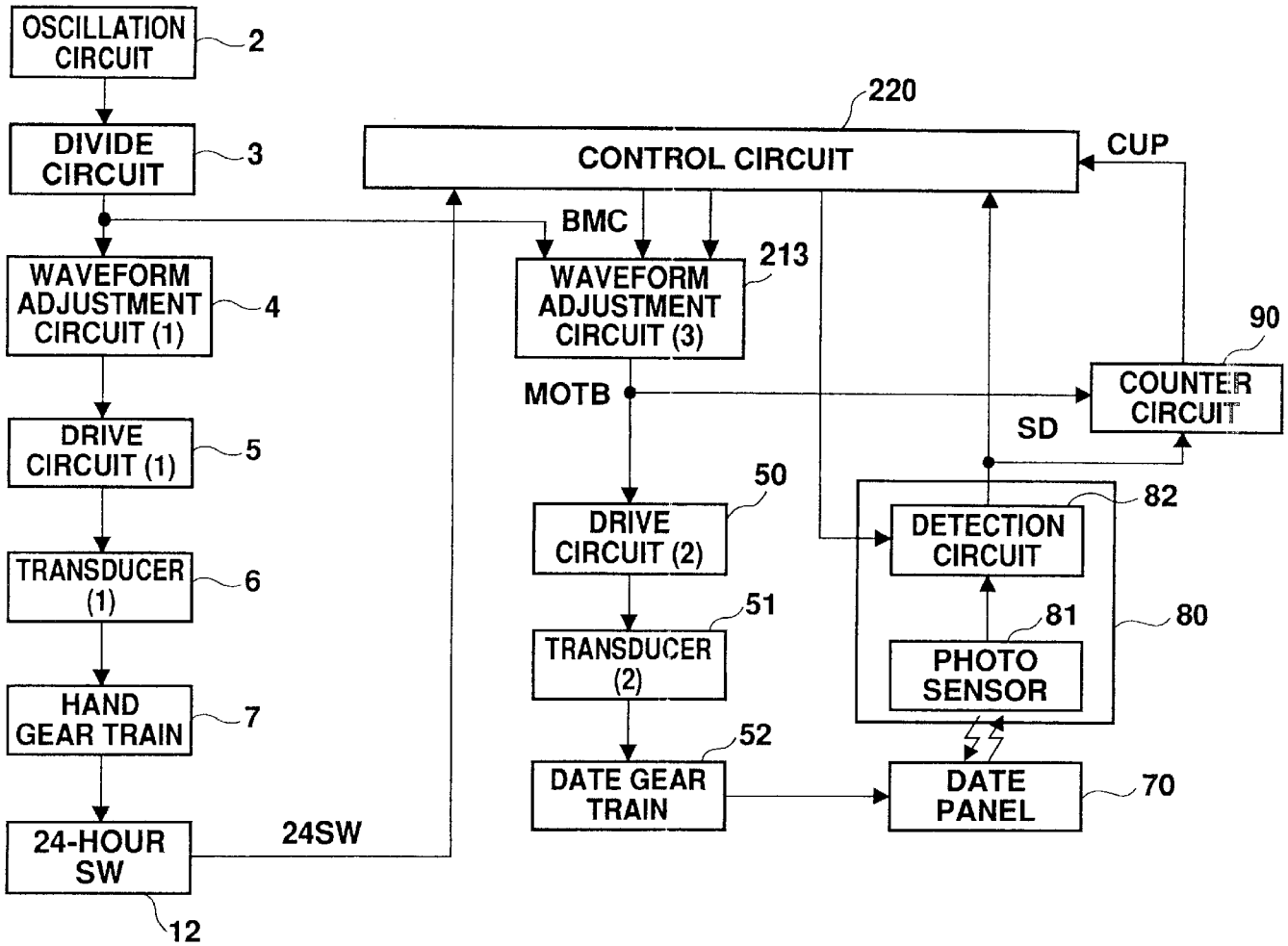
FIG. 13 is a block diagram showing a circuitry structure, corresponding to FIG. 2, of still another preferred embodiment of the present invention.

A preferred embodiment in which the speed of the transducer (2) 51 is changed will next be described. This embodiment is based on the understanding that load becomes larger only in advancing the date dial 70, and remains small when the transducer (2) 51 rotates before and after the advancement. Referring to FIG. 9, the date dial 70 is not yet rotated during a period from activation of the date dial advancement transducer (2) 51 to abutment of the feed tooth 56*b* of the date dial stabilizing Geneva wheel 56 on the teeth of the intermediate date wheel gear 57*a* of the date dial driving wheel 57*b*. During this period, the load due to rotation of the date dial 70 is small. Also, when the feed tooth 56*b* is disengaged with the teeth of the intermediate date wheel gear 57*a* with the date dial 70 having been rotated, that load becomes small again. FIG. 13 is a block diagram showing the circuitry structure of an electronic timepiece according this preferred embodiment, corresponding to that which is shown in FIG. 2, in which respective elements are given reference numerals corresponding to those in FIG. 2.

In the structure shown in FIG. 13, a detection signal SD from the photo sensor mechanism 80 is supplied also to the waveform adjustment circuit (3) 213.

Figure 14:
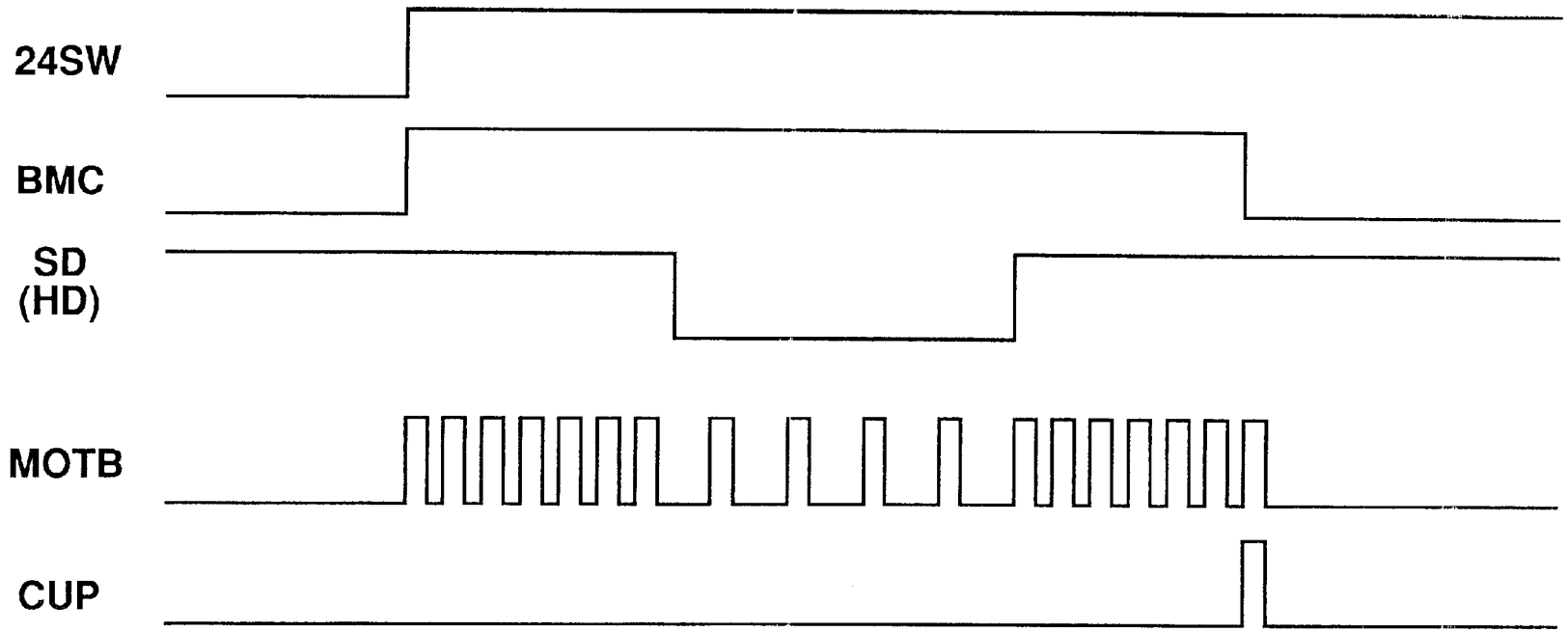
FIG. 14 is a diagram showing waveforms of signals generated by a circuit having the structure shown in FIG. 13.

FIG. 14 is a diagram showing waveforms of signals generated by the circuit having the structure shown in FIG. 13.

Referring to FIGS. 13 and 14, in response to a date dial drive signal 24SW from the 24-hour switch 12, the control circuit 220 outputs a date dial drive signal BMC to the waveform adjustment circuit (3) 213. Having received a signal from the divide circuit 3, the waveform adjustment circuit (3) 213 begins outputting a drive signal MOTB. The drive signal MOTB is output as a fast-forwarding pulse until the date dial 70 begins rotating due to the drive circuit (2) 50, the transducer (2) 51, and the date gear train 52. After the date dial 70 begins rotating, a photo sensor mechanism 80 detects change of the detection pattern 71 on the rear surface of the date dial, and a detection signal SD accordingly becomes L level. The L-level detection signal is supplied to the waveform adjustment circuit (3) 213 to switch a drive signal MOTB into a slow-forwarding pulse. Meanwhile, having received a detection signal SD, the counter circuit 90 begins counting a pulse of a signal MOTB.

Thereafter, when advancing of the date dial 70 is completed, and the detection signal SD from the photo sensor mechanism 80 thereupon becomes H-level, the waveform adjustment circuit (3) 213, receiving an H-level detection signal SD, switches the detection signal SD to a fast-forwarding pulse. The counter circuit 90 continuously counts the pulse of the drive signal MOTB until it has reached a predetermined number. When it has counted that predetermined number, the counter circuit 90 outputs a count up signal CUP, in response to which the control circuit 220 suspends output of a date dial drive signal BMC. As described above, since a drive signal MOTB is fast-forwarded before and after advancement of the date dial 70 (rotation of the date dial 70), reduction of a date change time can be achieved without imposing extra load on the drive circuit (2) 50. Also, as the signal is a slow-forwarding pulse while the date dial 70 is rotating, operation for advancing the date dial can be easily assured.

Figure 15:
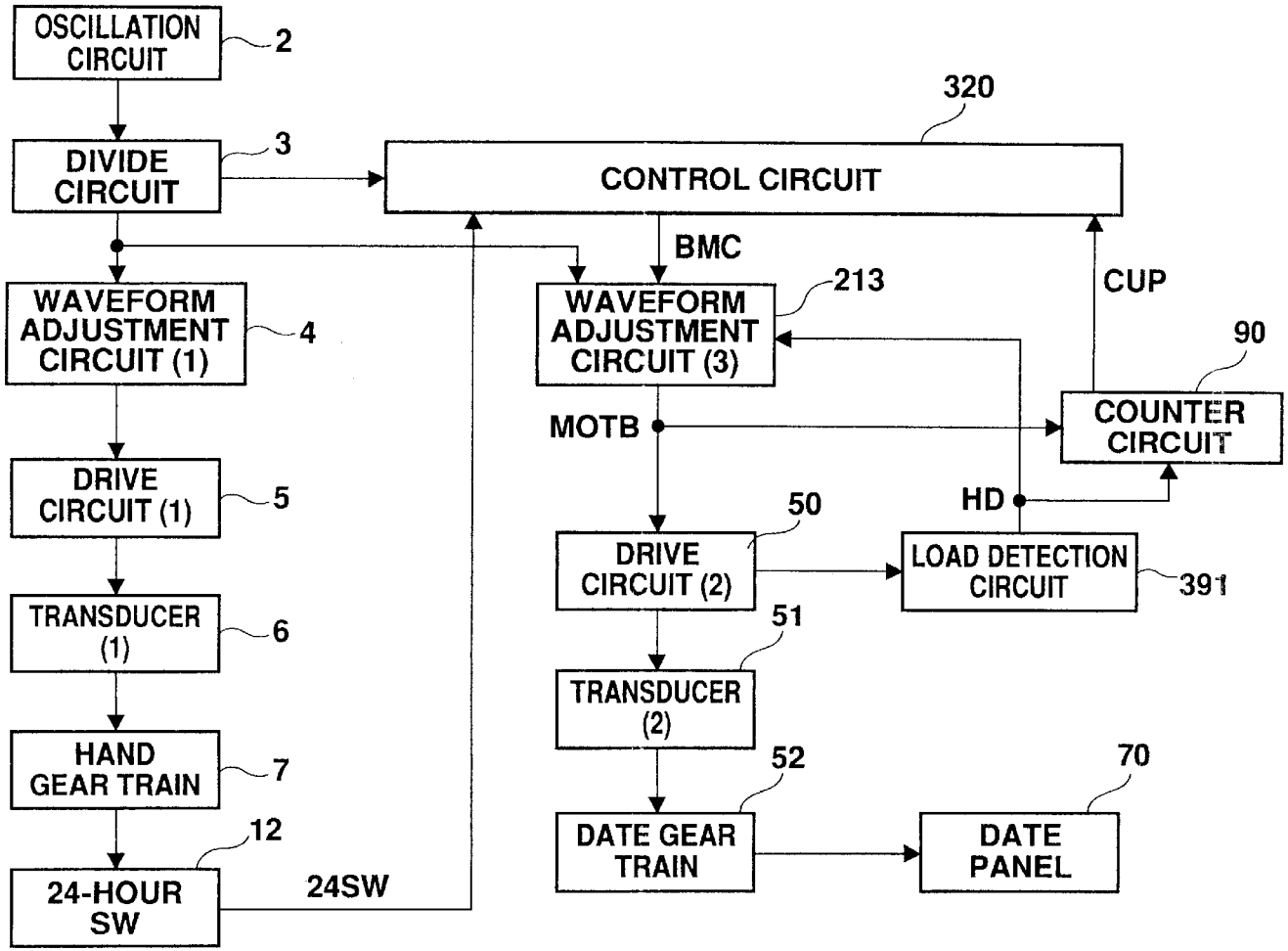
FIG. 15 is a block diagram showing a circuitry structure, corresponding to FIG. 13, of still another preferred embodiment of the present invention.

FIG. 15 is a block diagram showing a circuitry structure according to still another preferred embodiment, one corresponding to that which is shown in FIG. 13 and in which the respective members are given reference numerals corresponding to those shown in FIG. 11. In this embodiment, a load detection circuit 391 is provided in the place of the photo sensor mechanism, for detecting variation of load imposed on the drive circuit (2) 50.

Signals generated in the circuit having the structure shown in FIG. 15 have waveforms as shown in FIG. 12, except that the detection signal SD is replaced by a signal HD. A detection signal HD is shown in FIG. 14. The circuit relative to FIG. 15 operates basically in the same manner for the circuit relative to FIGS. 13 and 14.

In response to a signal 24SW from the 24-hour switch 12, the control circuit 320 outputs a date dial drive signal BMC to the waveform adjustment circuit (3) 213, which in turn outputs a drive signal MOTB. Larger load is imposed on the drive circuit (2) 50 when the date dial 70 is advanced. The increased load is detected by the load detection circuit 391 which accordingly changes the detection signal HD from H-level to L-level. Until the change of the signal level, the signal MOTB is a fast-forwarding pulse, similar to the embodiment of FIG. 13, and thereafter becomes a slow-forwarding pulse.

After the date dial 70 is advanced, the load on the drive circuit (2) 50 accordingly becomes smaller again and the detection circuit 391 outputs an H-level detection signal HD, in response to which the drive signal MOTB becomes a fast-forwarding pulse.

As described with reference to FIGS. 13 and 14, the counter circuit 90 starts counting the pulses of drive signals MOTB from the moment when the detection signal HD has changed from H-level to L-level. When the counter 90 has reached a predetermined number, it outputs a count up signal CUP to the control circuit 320 to stop the output of a date dial drive signal BMC. Also in the embodiment, as a drive signal MOTB is fast-forwarded before and after advancing the date dial 70 (rotation of the date dial), reduction of a date change time can be achieved without imposing extra load on the drive circuit (2) 59, and operation for date advancement can be easily assured.

Figure 16:
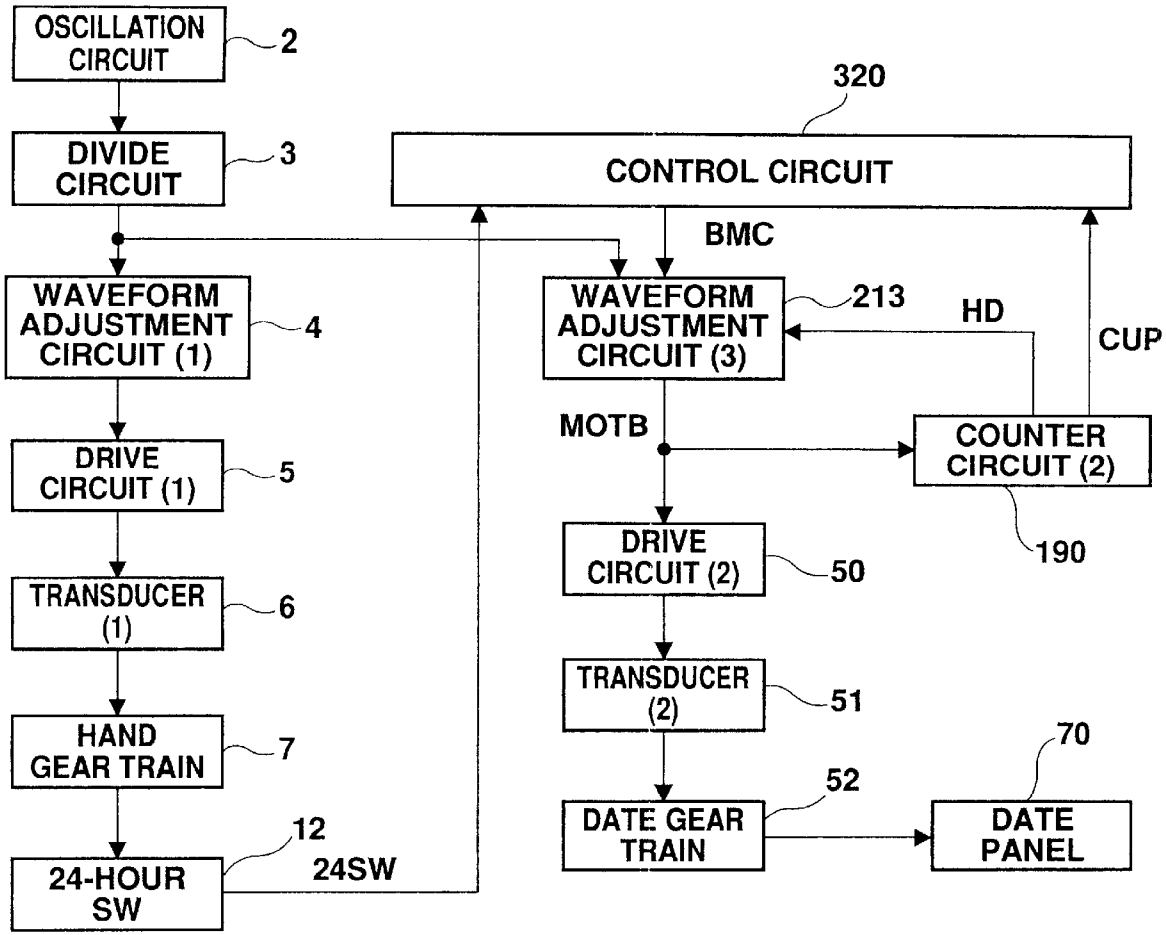
FIG. 16 is a block diagram showing a circuitry structure, corresponding to FIGS. 13 and 15, of still another preferred embodiment of the present invention.

FIG. 16 is a block diagram showing a circuitry structure of an electric timepiece according to yet another preferred embodiment corresponding to those which are shown in FIGS. 13 and 15. In this embodiment, the function of the photo sensor 80 in FIG. 13 or the load detection circuit 391 and the counter circuit 90 in FIG. 15 is achieved by a counter circuit (2) 190. Respective signals generated in the circuit having the structure shown in FIG. 16 have waveforms as shown in FIG. 14, except that the counter circuit (2) 190 outputs signals HD and CUP. The counter circuit (2) 190 begins counting the pulses of drive signals MOTB from the start of generation of drive signals MOTB (the drive signal MOTB then being a fast-forwarding pulse). When the counter circuit (2) 190 has reached a predetermined number, which is before starting advancement of the date dial, it changes the level of a signal HD from H-level to L-level. Based on the signal with a changed level, the drive signal MOTB is changed to a normal slow-forwarding pulse to be counted. When the predetermined number of drive signals MOTB have been counted, which corresponds to completion of advancing of the date dial, the signal HD becomes H-level again, and the signal MOTB thereupon becomes a fast-forwarding pulse again. Thereafter, the counter circuit (2) 190 continues counting a signal MOTB until it has counted a predetermined number whereupon it outputs a count-up signal CUP. In response to the count-up signal CUP, the control circuit 320 suspends output of the date dial drive signal BMC.

In another preferred embodiment of the present invention, the transducer (2) 51 is fast-rotated for correcting a calendar during a period from activation to stoppage of the date dial advancement transducer (2) 51.

Figure 17:
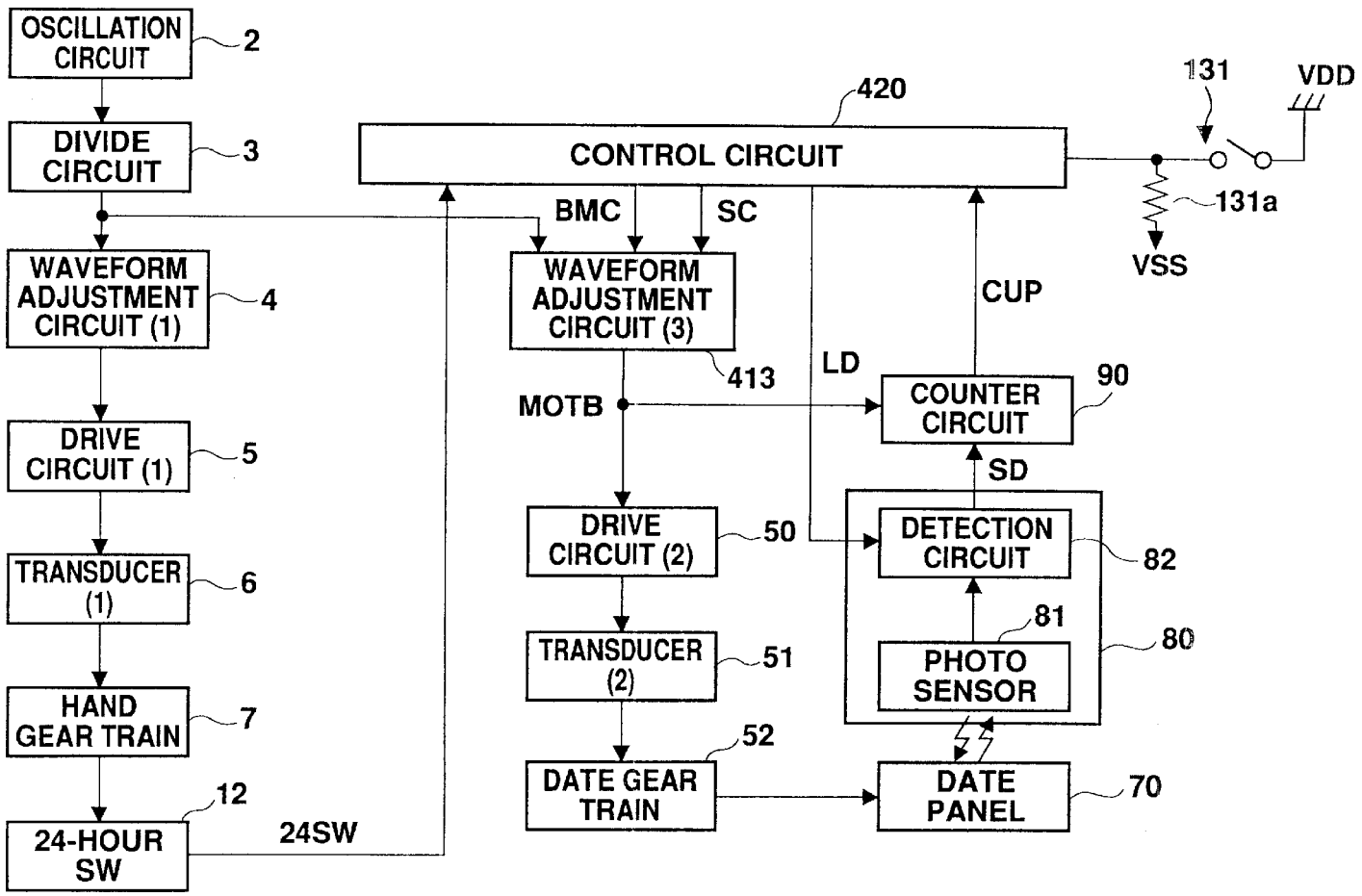
FIG. 17 is a block diagram showing a circuitry structure, corresponding to FIG. 2, of yet another preferred embodiment of the present invention.

FIG. 17 is a block diagram showing a circuitry structure of an electronic timepiece corresponding to that shown in FIG. 2, and in which identical components are given identical reference numerals to those in FIG. 2. In this drawing, the waveform adjustment circuit (3) 413, the control circuit 420, and the external operation switch 131 have different structures from those of the corresponding members shown in FIG. 2.

In normal operation, the date dial 70 is updated (advanced) in the same manner as described above with reference to FIG. 2.

When the external operation switch 131 is turned on by a winding crown or the like for correction, current flows via the resistance 131*a*, supplying a H-level signal to the control circuit 420. In response to the H-level signal, the control circuit 420 outputs a correction signal SC to the waveform adjustment circuit (3) 413. With this arrangement, the waveform adjustment circuit (3) 413 outputs a drive signal MOTB as a fast-forwarding pulse during a period when the date dial drive signal BMC is supplied to the waveform adjustment circuit (3) 413. As a result, correction can be promptly achieved.

INDUSTRIAL APPLICATION

As described above, an electronic timepiece having a calendar device according to the present invention is preferably used in an electronic wrist watch or a small portable timepiece.

What is claimed is:

1. An electronic timepiece having a date dial as a rotating indication panel for dates on a calendar, comprising:

a calendar advancement device, including a 24-hour switch for generating a date dial drive signal every twenty-four hours;

a date dial advancement transducer activated by a control circuit having received the date dial drive signal; and a date advancement mechanism having a date dial stabilizing Geneva wheel, and a date dial driving wheel for engagement with a flange of the Geneva wheel and a date wheel gear of the date dial, and being activated with force from said date dial advancement transducer.

2. An electronic timepiece having a calendar advancement device according to claim 1 further comprising:

a detection mechanism for detecting start to advance the date dial;

a counter circuit for counting for a predetermined amount of time in response to a signal from said detection mechanism; and a control circuit for suspending said date dial advancement transducer based on an output from said counter circuit to thereby suspend rotation of the date dial stabilizing Geneva wheel.

3. An electronic timepiece having a calendar advancement device according to claim 1, wherein a feed tooth of the date dial stabilizing Geneva wheel is located in a region opposite from said date dial driving wheel when the date dial is in a stabilized state.

4. An electronic timepiece having a calendar advancement device according to any one of claims 1, 2 and 3, further comprising a control circuit for fast-forward-rotating said date dial advancement transducer during a period from activation of said date dial advancement transducer to at least abutment of the feed tooth of the date dial stabilizing Geneva wheel on teeth of said date dial driving wheel.

5. An electronic timepiece having a calendar device according to claim 4, wherein abutment of the feed tooth of the date dial stabilizing Geneva wheel on the teeth of said date dial driving wheel is judged from a number counted by said counter circuit.

6. An electronic timepiece having a calendar device according to claim 2, wherein the detection mechanism for detecting start to advance the date dial has a pattern provided on the date dial and a photo sensor for detecting the pattern.

7. An electronic timepiece having a calendar device according to claim 2, wherein the detection mechanism for detecting start to advance the date dial has a load detection circuit for detecting load on a drive circuit for said date dial advancement transducer.

8. An electronic timepiece having a calendar advancement device according to claim 2, further comprising a control circuit for fast-forward-rotating said date dial advancement transducer for correction of the calendar during a period from activation to stoppage of said date dial advancement transducer.

9. An electronic timepiece having a calendar advancement device according to claim 4, further comprising a control circuit for fast-forward-rotating said date dial advancement transducer for correction of the calendar during a period from activation to stoppage of said date dial advancement transducer.

10. An electronic timepiece having a calendar device according to claim 4, wherein abutment of the feed tooth of the date dial stabilizing Geneva wheel on the teeth of said date dial driving wheel is detected from a signal from a detection mechanism for detecting start to advance the date dial.

11. An electronic timepiece having a calendar device according to claim 10, wherein the detection mechanism for detecting start to advance the date dial has a pattern provided on the date dial and a photo sensor for detecting the pattern.

12. An electronic timepiece having a calendar device according to claim 10, wherein the detection mechanism for detecting start to advance the date dial has a load detection circuit for detecting load on a drive circuit for said date dial advancement transducer.

13. An electronic timepiece having a calendar device according to claim 3, wherein the feed tooth of the date dial stabilizing Geneva wheel is held in a position, when the date dial is in a stabilized state, which is determined according to a ratio between forward and backward rotation speeds of said date dial advancement transducer so that the correcting of the date dial starts after a substantially same amount of time through either forward or backward rotation.

14. An electronic timepiece having a calendar advancement device according to claim 3, further comprising a control circuit for fast-forward-rotating said date dial advancement transducer for correction of the calendar during a period from activation to stoppage of said date dial advancement transducer.

15. An electronic timepiece having a calendar advancement device according to claim 1, further comprising a control circuit for fast-forward-rotating said date dial advancement transducer for correction of the calendar during a period from activation to stoppage of said date dial advancement transducer.

16. An electronic timepiece having a date dial as a rotating indication panel for dates on a calendar, comprising:

a control device for dates on a calendar, including
- a date advancement transducer for driving a date dial;
- a slow-down gear train for transmitting rotation force of said date advancement transducer to the date dial;
- a date dial intermittent rotation drive device constituting a part of said slow-down gear train, for intermittently driving the date dial; and
- a bounding restraint lever, movable by said intermittent rotation drive device, for restraining rotation of the date dial in a non-driven state, and releasing rotation restraint on the date dial in a driven state.

17. An electronic timepiece according to claim 16, wherein said bounding restraint lever is engaged with teeth of the date dial in a non-driven state for rotation restraint, and departs from the teeth of the date dial in a driven state for releasing load due to pressing force applied to the date dial.

18. An electronic timepiece having a date dial as a rotating indication panel for dates on a calendar, comprising:

a control device for dates on a calendar, including
- a date advancement transducer for driving a date dial;
- a slow-down gear train for transmitting rotation force of said date advancement transducer to the date dial;
- a bounding restraint lever for restraining rotation of the date dial in a non-driven state, and releasing rotation restraint on the date dial in a driven state, wherein said bounding restraint lever is engaged with teeth of the date dial in a non-driven state for rotation restraint, and departs from the teeth of the date dial in a driven state for releasing load due to pressing force applied to the date dial; and
- a date dial intermittent rotation drive device constituting a part of said slow-down gear train, for intermittently driving the date dial, comprising:
  - a date dial driving wheel arranged to continuously engage with the date dial,
  - a date intermediate wheel having feed teeth for intermittent engagement with said date dial driving wheel, and
  - an eccentric cam for engagement with and rotating said bounding restraint lever,
  - wherein said date intermediate wheel and said eccentric cam have a common rotation center.

19. An electronic timepiece according to claim 18, wherein a bearing is provided between said eccentric cam and said feed teeth, for receiving an axis of said date intermediate wheel.

20. An electronic timepiece according to claim 18, wherein said bounding restraint lever, said eccentric cam, and the teeth of the date dial for engagement with said date dial driving wheel are provided on a same planar surface.

* * * * *